US005568247A

United States Patent [19]

Murata et al.

[11] Patent Number: 5,568,247

[45] Date of Patent: Oct. 22, 1996

[54] IMAGE FORMING SYSTEM CAPABLE OF STAPLING SHEETS AT PLURAL POINTS

[75] Inventors: Mitsushige Murata, Yokohama; Norifumi Miyake, Tokyo; Kazuo Onodera, Ibaraki-ken, all of Japan

[73] Assignee: Canon Kabushiki Kaisha, Tokyo, Japan

[21] Appl. No.: 364,230

[22] Filed: Dec. 27, 1994

[30] Foreign Application Priority Data

Dec. 29, 1993 [JP] Japan ..... 5-354347

[51] Int. Cl.[6] ..... G03G 21/00

[52] U.S. Cl. ..... 355/324; 355/313; 355/321

[58] Field of Search ..... 355/208, 308, 355/309, 313, 319, 321, 324

[56] References Cited

U.S. PATENT DOCUMENTS

| | | | |
|---|---|---|---|
| 5,060,921 | 10/1991 | Higashio et al. | 355/324 X |
| 5,229,812 | 7/1993 | Toyama et al. | 355/324 X |
| 5,236,189 | 8/1993 | Ikoma | 355/324 X |
| 5,257,081 | 10/1993 | Kato et al. | 355/324 |
| 5,263,698 | 11/1993 | Higuchi et al. | 355/324 X |

FOREIGN PATENT DOCUMENTS

| | | |
|---|---|---|
| 0346851 | 12/1989 | European Pat. Off. . |
| 0568796 | 11/1993 | European Pat. Off. . |
| 2844098 | 4/1979 | Germany . |
| 4290800 | 10/1992 | Japan . |
| 2187174 | 9/1987 | United Kingdom . |
| 2248608 | 4/1992 | United Kingdom . |
| 2260124 | 4/1993 | United Kingdom . |
| 2288793 | 11/1995 | United Kingdom . |

*Primary Examiner*—Sandra L. Brase
*Attorney, Agent, or Firm*—Fitzpatrick, Cella, Harper & Scinto

[57] ABSTRACT

It is an object of this invention to provide a stapling apparatus which binds sheets like a book by stapling the sheets at two points in a both sides copying mode or in a mode in which a cover is added to the sheets. This stapling apparatus includes a stapling unit for selectively performing stapling at one or a plurality of points of a plurality of sheets ejected from an image forming apparatus, and a control unit for controlling the stapling unit to perform stapling at a plurality of points of sheets ejected when the image forming apparatus is in a specific mode.

10 Claims, 25 Drawing Sheets

IMAGE FORMING SYSTEM CAPABLE OF STAPLING SHEETS AT PLURAL POINTS

BACKGROUND OF THE INVENTION

1. Field of the Invention

The present invention relates to a stapling apparatus capable of stapling sheets at a plurality of points.

2. Related Background Art

An apparatus for stapling sheets ejected from a copying machine has been conventionally available.

These conventional stapling apparatuses staple sheets at one corner portion.

One recently proposed stapling apparatus can staple copied Sheets at two points in order that the sheets can be turned over like a book.

Unfortunately, a stapling apparatus of this sort is so designed that one-point stapling or two-point stapling is chosen by an operator. Therefore, an operator may inadvertently select one-point stapling even in specific cases in which two-point stapling is obviously preferred, e.g., in stapling sheets copied both-sided or in stapling sheets added with color paper as a cover.

SUMMARY OF THE INVENTION

It is an object of the present invention to provide a stapling apparatus which solves the above conventional problem.

It is another object of the present invention to provide a stapling apparatus capable of automatically selecting two-point stapling when two-point stapling is preferred.

Other objects and features of the invention will become apparent from the following detailed description taken in conjunction with the drawings.

DETAILED DESCRIPTION OF THE PREFERRED EMBODIMENT

Figure 1:
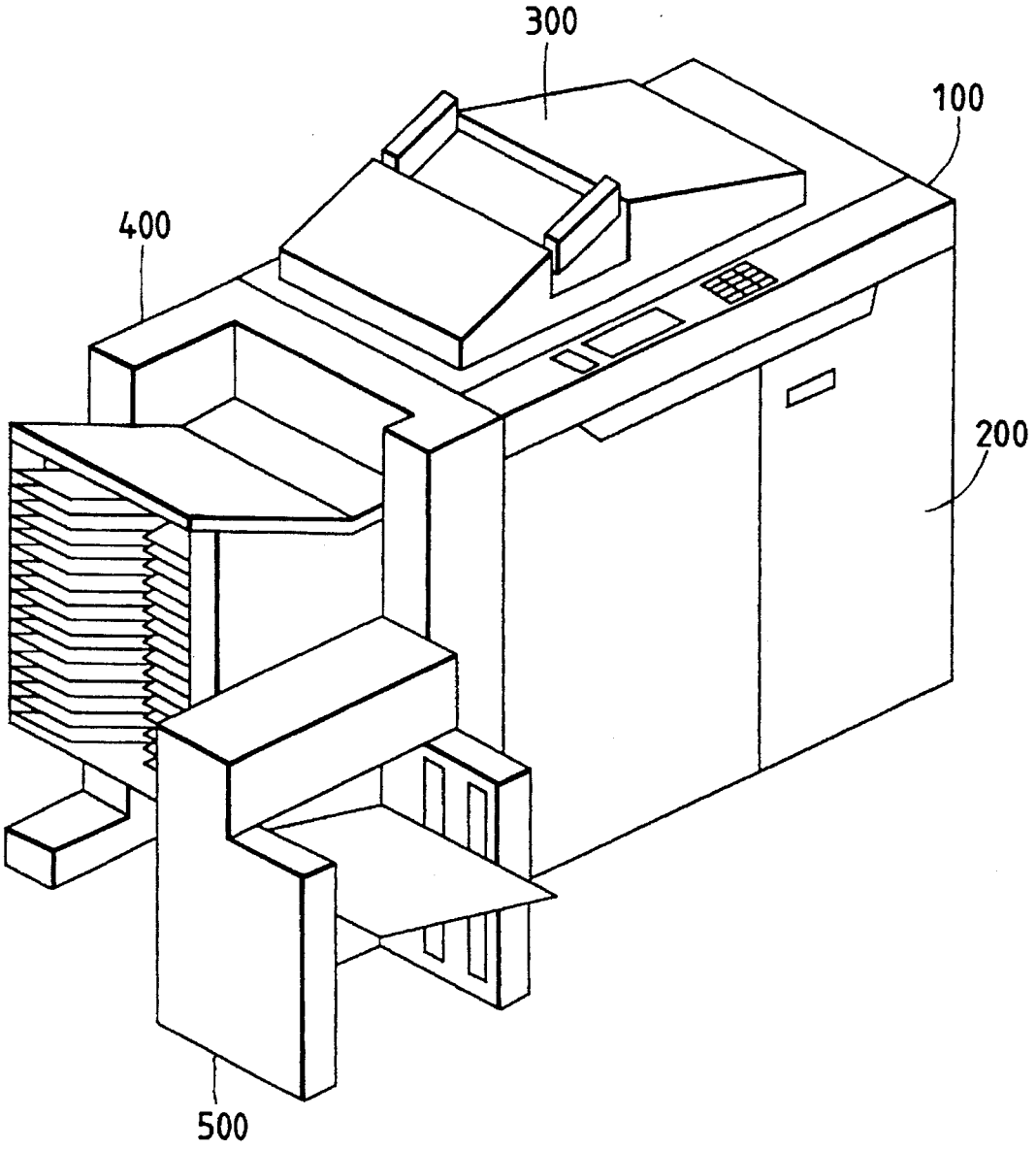
FIG. 1 is a perspective view of an outer appearance for explaining the arrangement of an image forming system according to an embodiment of the present invention.

FIG. 1 is a perspective view of an outer appearance for explaining the arrangement of an image forming system according to an embodiment of the present invention.

Referring to FIG. 1, an image forming apparatus (main body) 100 is mounted on a pedestal 200 which stores bundles of sheet materials (sheets of transfer paper) each of a predetermined size and sequentially feeds transfer sheets corresponding to the selected paper size. This image forming system also includes an automatic repetitive document feeder (RDF) 300, a sheet postprocessing apparatus (a sorter) 400, and a sheet bundle stacking apparatus (a stacker) 500.

The arrangement of the image forming system will be described below with reference to the sectional view in FIG. 2.

Figure 2:
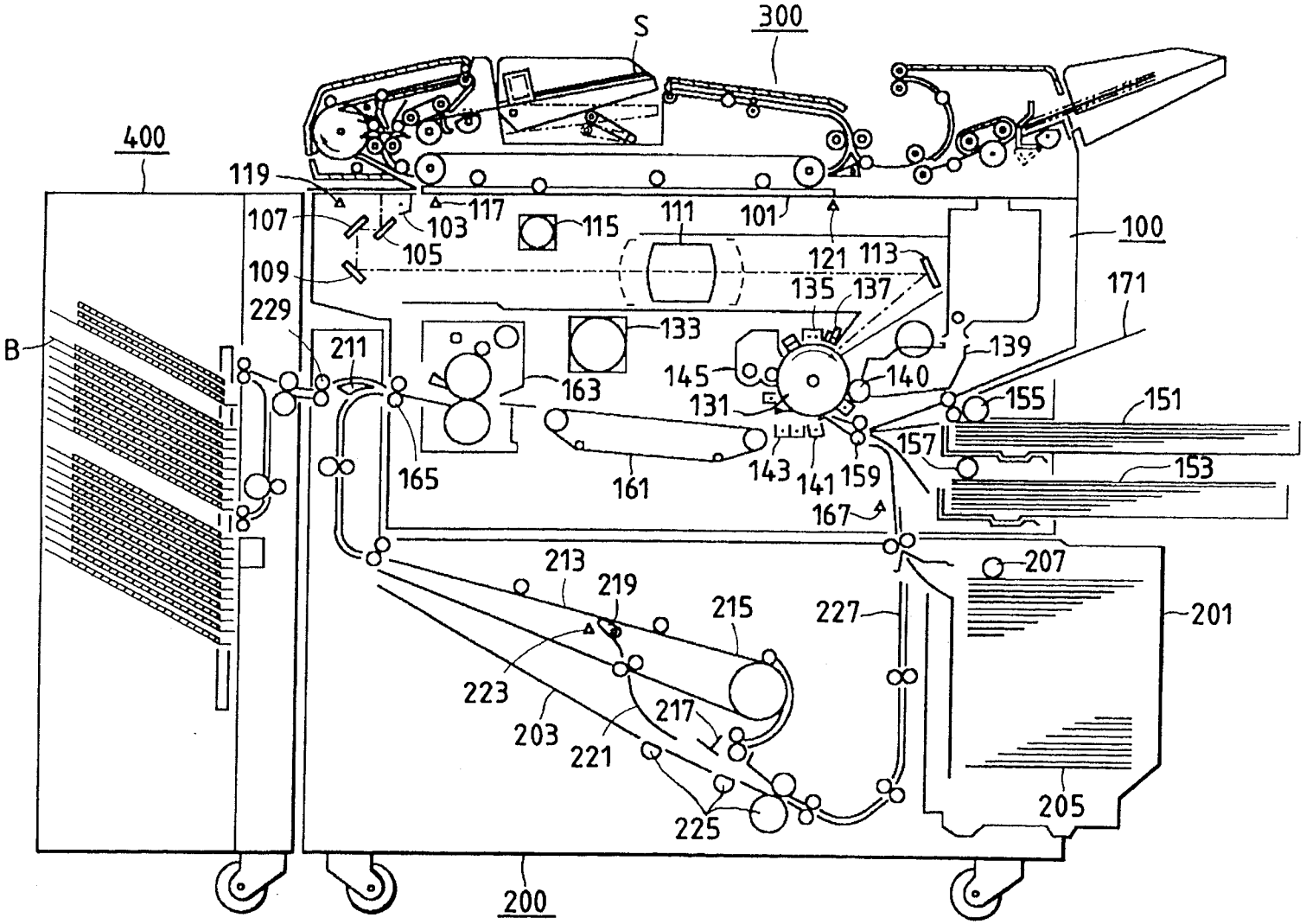
FIG. 2 is a sectional view for explaining details of the main parts of the image forming system shown in FIG. 1.

FIG. 2 is a sectional view for explaining details of the major components of the image forming system illustrated in FIG. 1.

The main body 100 includes a platen glass 101 for placing an original, an illumination lamp (an exposure lamp) 103 for illuminating an original, scanning mirrors 105, 107, and 109 for changing the optical path of an original, a lens 111 with focusing and magnification varying functions, a fourth reflecting mirror (a scanning mirror) 113 for changing the optical path, an optical system motor 115 for driving an optical system, and sensors 117, 119, and 121.

The main body 100 also includes a photosensitive drum 131, a main motor 133 for driving the photosensitive drum 131, a high-voltage unit 135, a blank exposure unit 137, a developing unit 139, a developing roller 140, a transfer charger 141, a separation charger 143, and a cleaning unit 145.

The main body 100 further comprises an upper paper feeding cassette 151, a lower paper feeding cassette 153, a manual paper feeding port 171, paper feeding rollers 155 and 157, and registration rollers 159. A conveyor belt 161 conveys a transfer sheet on which an image is recorded to a fixing unit 163 which in turn fixes the image on the conveyed transfer sheet with heat and pressure. A sensor 167 is used to detect arrival of a transfer sheet in both-side recording.

The surface of the photosensitive drum 131 is made from a seamless photosensitive body using a photoconductor and a conductor. The photosensitive drum 131 is axially supported to be rotatable and is rotated in the direction indicated by an arrow in FIG. 2 by the main motor 133 which operates in response to depression of an image formation start key (to be described later). When predetermined rotation control processing and potential control processing (together called pre-rotation processing) of the photosensitive drum 131 are completed, an original placed on the platen glass 101 is illuminated by the illumination lamp 103 which is formed integrally with the first scanning mirror 105. The reflected light from the original forms an image on the photosensitive drum 131 via the first, second, and third scanning mirrors 105, 107, and 109, the lens 111, and the fourth scanning mirror 113. The photosensitive drum 131 is then corona-charged by the high-voltage unit 135. Thereafter, the image (original image) irradiated by the illumination lamp 103 is slit-exposed to form an electrostatic latent image on the photosensitive drum 131 in accordance with a known Carlson method.

The electrostatic latent image formed on the photosensitive drum 131 is developed by the developing unit 139 and the developing roller 140 and is thereby visualized as a toner image. The resultant toner image is transferred onto a transfer sheet by the transfer charger 141 as follows.

That is, a transfer sheet stored in the upper or lower paper feeding cassette 151 or 153 or a transfer sheet set in the manual paper feeding port 171 is fed into the main body 100 by the paper feeding roller 155 or 157. The transfer sheet is then supplied in the direction to the photosensitive drum 131 at an accurate timing by the registration rollers 159, and consequently the leading end of the transfer sheet is aligned with the leading end of the latent image. Thereafter, the toner image on the photosensitive drum 131 is transferred onto the transfer sheet as the transfer sheet passes between the transfer charger 141 and the photosensitive drum 131. After the transfer is completed, the transfer sheet is separated from the photosensitive drum 131 by the separation charger 143, guided to the fixing unit 163 by the conveyor belt 161, and fixed with pressure and heat. Thereafter the transfer sheet is ejected from the main body 100 by paper ejecting rollers 165.

After the transfer the photosensitive drum 131 keeps rotating, and its surface is cleaned by the cleaning unit 145 consisting of a cleaning roller and an elastic blade.

The pedestal 200 can be separated from the main body 100 and has a deck 201 capable of storing 2,000 transfer sheets and an intermediate tray 203 for copying of both sides. A lifter 205 of the deck 201 capable of storing 2,000 sheets rises in accordance with the amount of remaining transfer sheets so that each transfer sheet comes in contact with a paper feeding roller 207. The pedestal 200 also includes a paper ejecting flapper 211 for performing switching between a both-side/multiple recording path and a paper ejecting path, conveying paths 213 and 215 of the conveyor belt, and an intermediate tray weight 217 for pressing down transfer sheets. Transfer sheets passing through the paper ejecting flapper 211 and the conveying paths 213 and 215 are turned over and stored in the intermediate tray 203 for both-side copying. A flapper 219 performs 8witching between a both-side recording path and a multiple recording path. The flapper 219 is arranged between the conveying paths 213 and 215 and guides a transfer sheet to a multiple recording conveying path 221 by pivoting upward. A sensor 223 detects the trailing end of a transfer sheet passing through the flapper 219. Paper feeding rollers 225 feed a transfer sheet to the photosensitive drum 131 through a path 227. Paper ejecting rollers 229 eject a transfer paper from the machine.

In both-Side recording (both-side copying) or multiple recording (multiple copying), the paper ejecting flapper 211 is raised to store transfer sheets, on which an image is already formed, in the intermediate tray 203 through the conveying paths 213 and 215 of the pedestal 200. In this case the flapper 219 is pivoted downward if the recording is both-side recording and pivoted upward if the recording is multiple recording. The intermediate tray 203 can store, e.g., up to 99 transfer sheets. The transfer sheets stored in the intermediate tray 203 are pressed down by the intermediate tray weight 217.

In rear-side recording or multiple recording to be performed next, the transfer sheets stored in the intermediate tray 203 are guided one after another from the one at the bottom to the registration rollers 159 of the main body 100 through the path 227 by the actions of the paper feeding rollers 225 and the weight 217.

Figure 3:
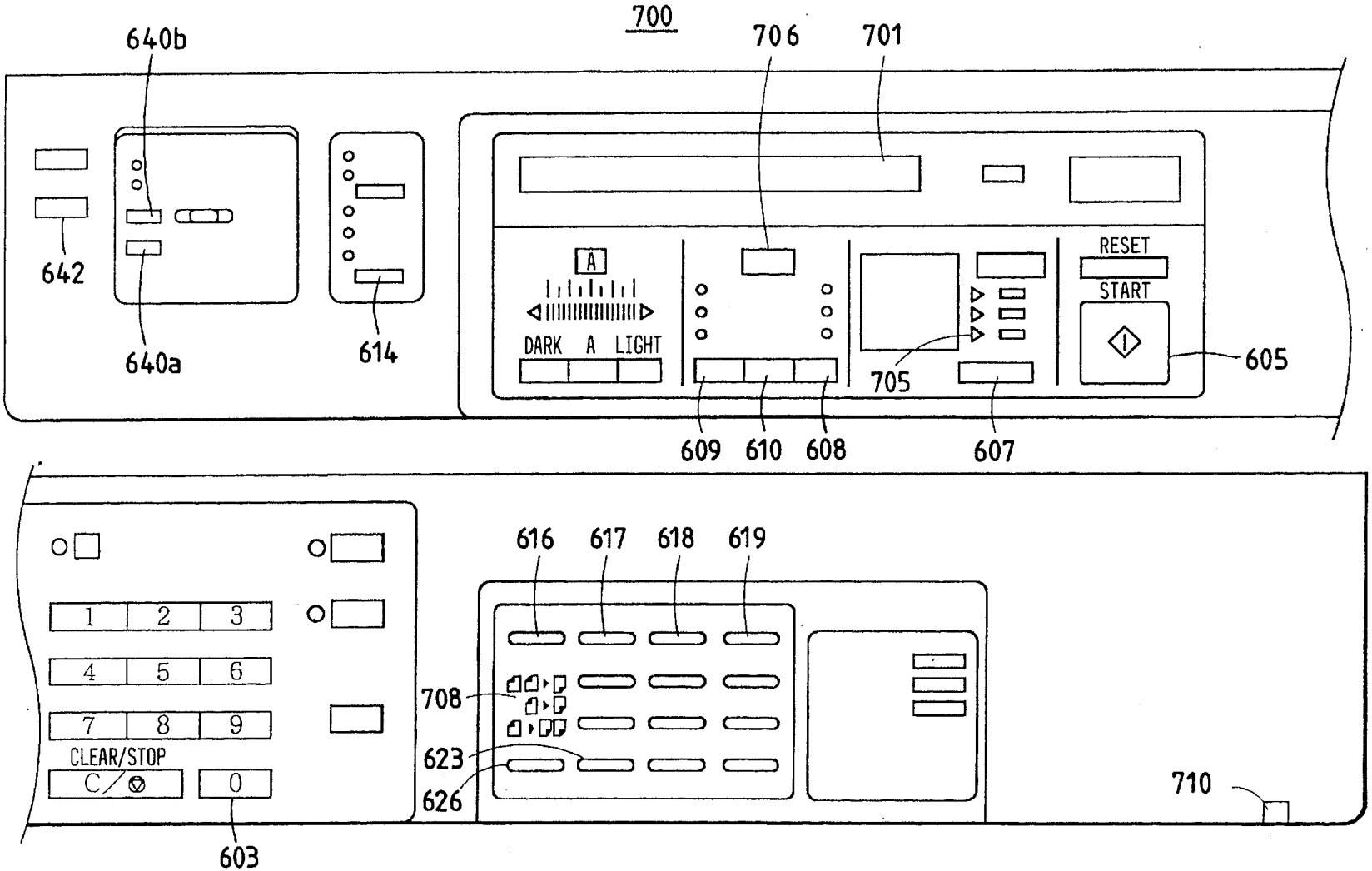
FIG. 3 is a plan view showing a practical example of an operation panel provided on the main body in FIG. 1.
Figure 4:
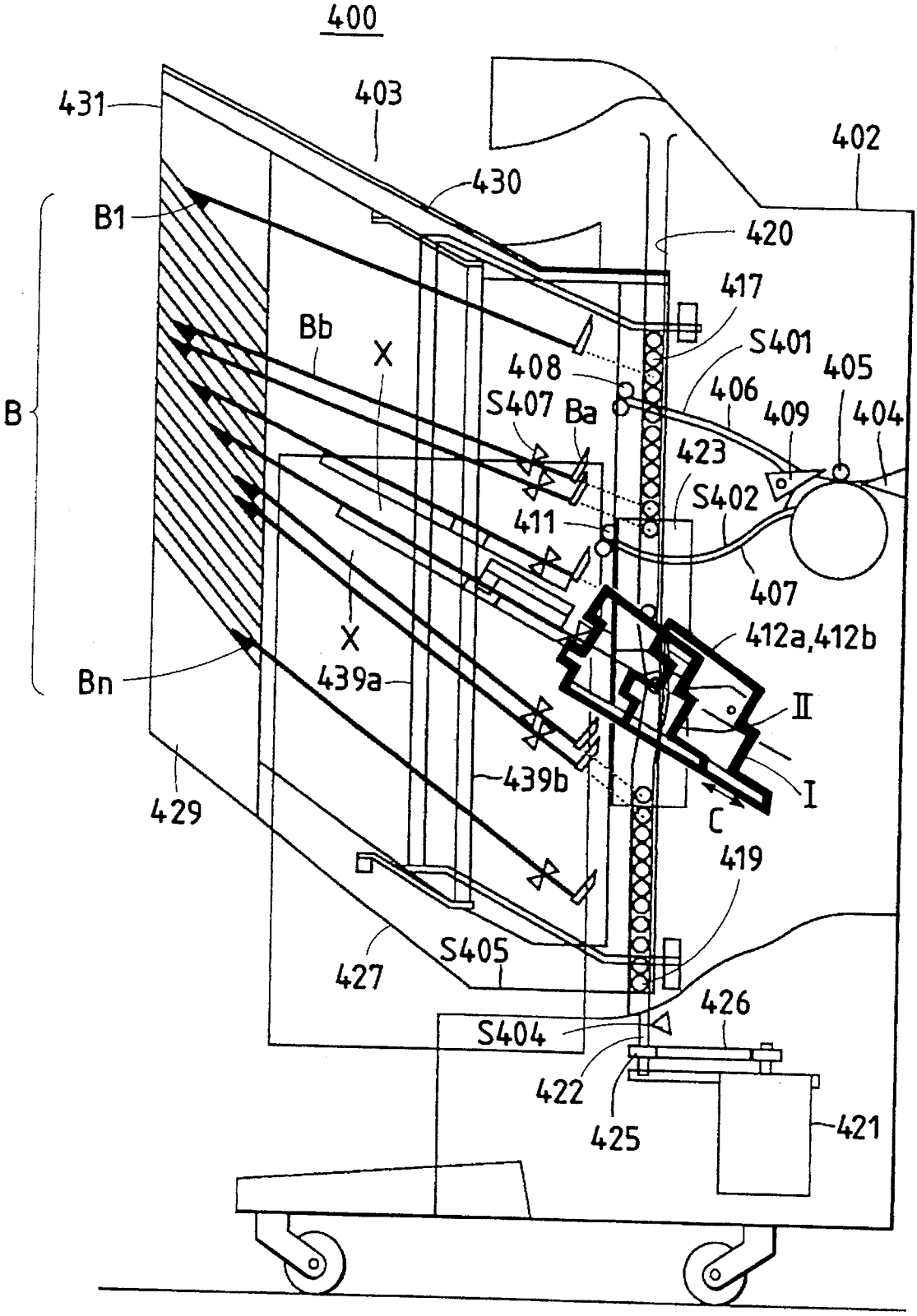
FIG. 4 is a sectional view for explaining details of the arrangement of a sheet postprocessing apparatus shown in FIG. 1.
Figure 5:
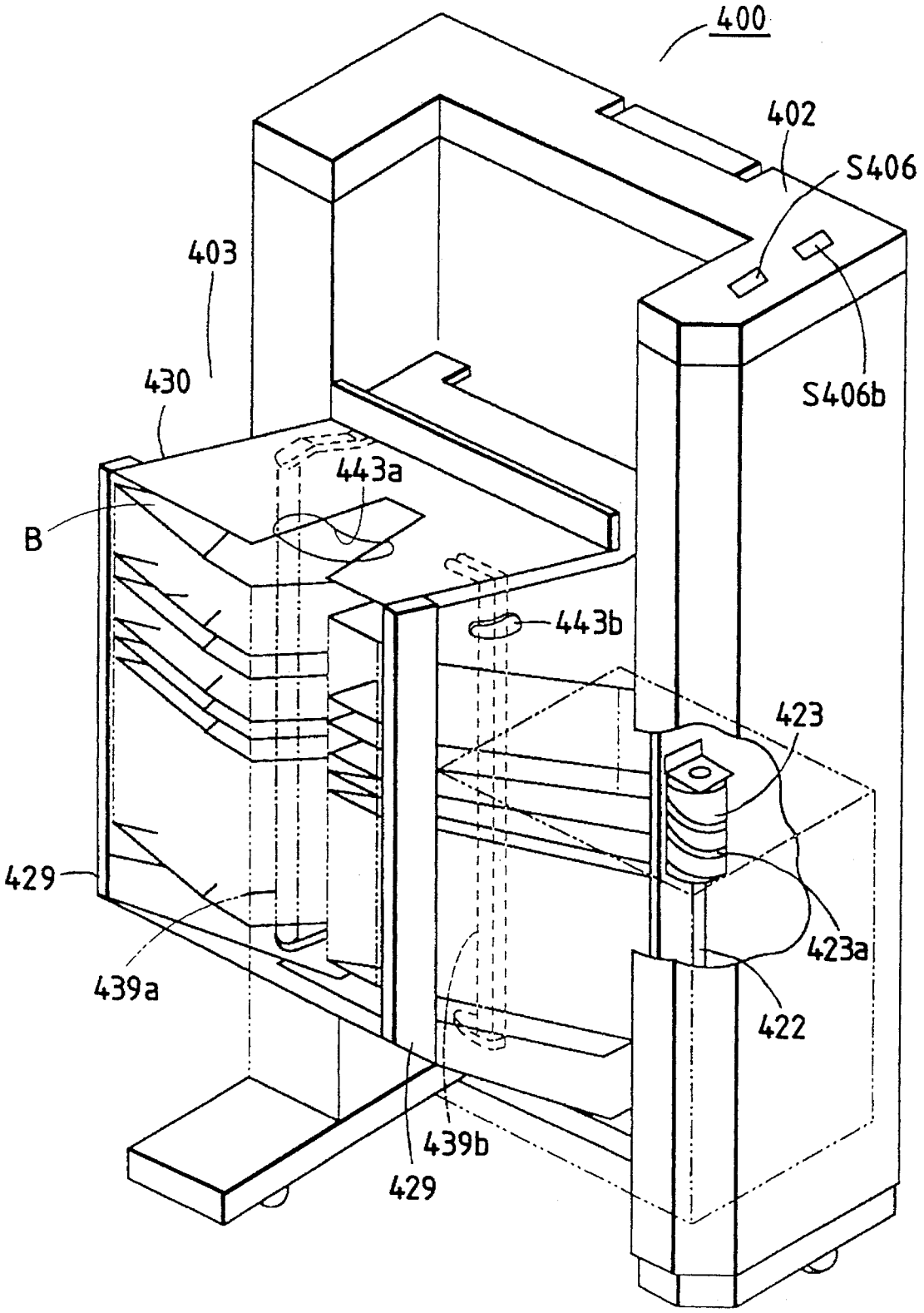
FIG. 5 is a perspective view for explaining details of the arrangement of the sheet postprocessing apparatus in FIG. 1.

FIG. 3 is a plan view showing a practical example of an operation panel provided on the main body 100 illustrated in FIG. 1.

Referring to FIG. 3, a start key 605 is used to designate start of image formation. Ten keys 603 are depressed to set the number of copies. A cassette select key 607 is depressed to select one of the upper cassette 151, the lower cassette 153, and the deck 201. When an original is placed on the RDF 300, APS (Automatic Paper Select) can be chosen by the cassette select key 607. When APS is chosen, a cassette storing transfer sheets of the same size as the original is automatically selected. A cover mode select key 619 is for selecting a cover mode. In the cover mode, a color sheet is set in the upper cassette 151 and white sheets are set in the lower cassette 153, for example, image formation is performed on the white sheets in sequence from the last page of originals, and lastly the color sheet is fed as a cover.

An equal magnification key 610 is depressed in performing copying with an equal magnification (original size). An automatic variable magnification key 616 is depressed to automatically reduce or enlarge an image of an original in accordance with a designated transfer sheet size. Zoom keys 617 and 618 are depressed to designate an arbitrary magnification between 64 and 142%. Fixed-form variable magnification keys 608 and 609 are depressed to designate reduction/enlargement of the size of a fixed form. A both-side key 626 is depressed to obtain both-sided copies from a single-sided original, both-sided copies from a both-sided original, or single-sided copies from a both-sided original.

A multiple key 623 is depressed in forming (synthesizing) images from two originals on the same surface of a transfer sheet. A paper ejecting method (staple, sort, group) select key 614 is for selecting a paper ejecting method. When a stapler which can staple recorded sheets is connected to the system, select and release of a staple mode and a sort mode can be designated by the key 614. When a sort tray (a sorter) is connected to the system, select and release of the sort mode and a group mode can be designated by the key 614.

Staple mode select keys 640*a* and 640*b* can designate one of one-point stapling and two-point stapling. A stacker select key 642 can select one of use and nonuse of the stacker.

A message display 701 of the liquid crystal type displays information pertaining to image formation. For example, the display 701 displays a message of 40 characters each constituted by 5×7 dots. The display 701 can also display an image formation magnification set by any of the fixed-form variable magnification keys 608 and 609, the equal magnification key 610, and the zoom keys 617 and 618. In addition, the display 701 is a semi-transmission type liquid crystal which can display two colors using back lights. In normal operations, a green back light is ON. If an abnormality occurs or image formation becomes impossible, an orange back light is turned on. An equal magnification indicator 706 is turned on when an equal magnification is chosen.

A use cassette indicator 705 indicates which of the upper cassette 151, the lower cassette 153, and the deck 201 is selected.

A both-side image formation indicator 708 is turned on when one of both-side image formation from a both-sided original and both-side image formation from a single-sided original is selected.

A power lamp 710 is lit when a power switch is turned on.

FIGS. 4 to 7 are views for explaining details of the arrangement of the sheet postprocessing apparatus 400 illustrated in FIG. 1.

In these drawings, the sorter 400 comprises a machine body 402 and a bin unit 403. The machine body 402 includes a pair of loading rollers 405 in the vicinity of a conveying port 404. On the downstream side of the pair of loading rollers 405, a flapper 409 for switching the conveying direction to a conveying path 406 or a conveying path 407 is disposed.

The conveying path 406 extends upward, and a pair of conveying rollers 408 is disposed downstream of the conveying path 406. The conveying path 407 extends downward, and a pair of conveying rollers 411 is disposed downstream of the conveying path 407. Staplers 412*a* and 412*b* are disposed near the pair of conveying rollers 411. The pair of loading rollers 405 and the pairs of conveying rollers 408 and 411 are driven by conveying motors (not shown). A non-sort path sensor S401 for detecting passing of a sheet is arranged in the conveying path 406. A sort path sensor S402 is arranged in the conveying path 407.

The bin unit 403 having a large number of bins B is arranged downstream of the pair of conveying rollers 408 and 411. The bin unit 403 is held by a spring one end of which is engaged with a hook of the bin unit 403 and the other end of which is fixed to the machine body 402. The bin unit 403 is so supported as to be movable up and down by this spring.

Guide rollers 417 and 419 are pivotally supported at the upper and lower portions of the proximal end of the bin unit 403. These guide rollers 417 and 419 guide the bin unit 403 by rolling in a guide groove 420 which is formed in the machine body 402 to extend vertically. A shift motor 421 is also disposed in the machine body 402. A lead cam 423 and a sprocket 425 are fixed to a rotating shaft 422 axially supported by the machine body 402. A chain 426 is looped between the sprocket 425 and the output shaft of the shift motor 421. Therefore, the rotation of the shift motor 421 is transmitted to the rotating shaft 422 via the chain 426.

The bin unit 403 further includes a unit main body 431 which is constituted by a bottom frame 427, a pair of frames 429, and a cover 430. The bottom frame 427 consists of an inclined portion and a vertical portion. The frames 429 are formed vertically on the front and back sides of the distal end of the bottom frame 427. The cover 430 is supported by these frames 429.

A reference plate 455 which can match or align a sheet S (see FIG. 7) by contacting it is provided on the front side of the unit main body 431.

Figure 6:
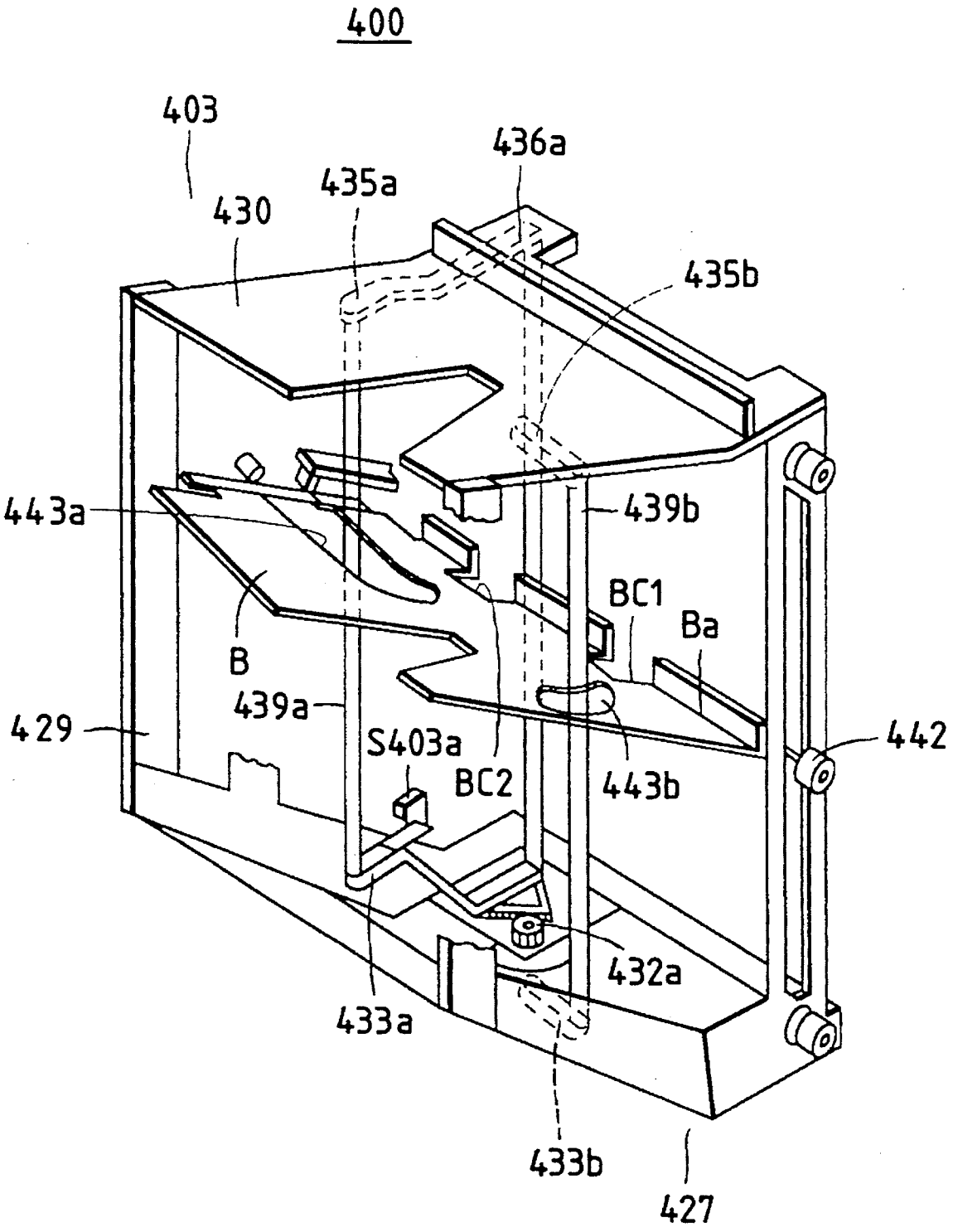
FIG. 6 is a perspective view for explaining details of the arrangement of the sheet postprocessing apparatus in FIG. 1.

A lower arm 433*a* which is pivoted by a matching motor 432*a* is pivotally supported on the back side of the proximal end of the bottom frame 427 (see FIG. 6). In addition, an upper arm 435*a* is disposed at a position at which it opposes the lower arm 433*a*. A shaft 436*a* extends between the pivotal center of the upper arm 435*a* and that of the lower arm 433*a*.

A matching rod 439*a* extends between the distal end of the lower arm 433*a* and that of the upper arm 435*a*. The matching rod 439*a* is pivoted by the matching motor 432*a* to match the sheet S on the bin B on the front side.

A lower arm 433*b* which is pivoted by the matching motor is supported on the back side of the proximal end of the bottom frame 427 (see FIG. 6). In addition, an upper arm 435*b* is disposed at a position at which it opposes the lower arm 433*b*.

A matching rod 439*b* extends between the distal end of lower arm 433*b* and that the upper arm 435*b*. The matching rod 439*b* is pivoted by the matching motor to match the sheet S on the bin B on the back side.

The matching motor is constituted by a stepping motor. The positions of the matching rods 439*a* and 439*b* can be accurately controlled by the number of pulses applied to the stepping motor. A matching rod sensor S403*a* detects the position of the matching rod 439*a*. The positions of the matching rods 439*a* and 439*b* are controlled by the numbers of pulses applied to the matching rod home position sensor and the matching motor.

Figure 7:
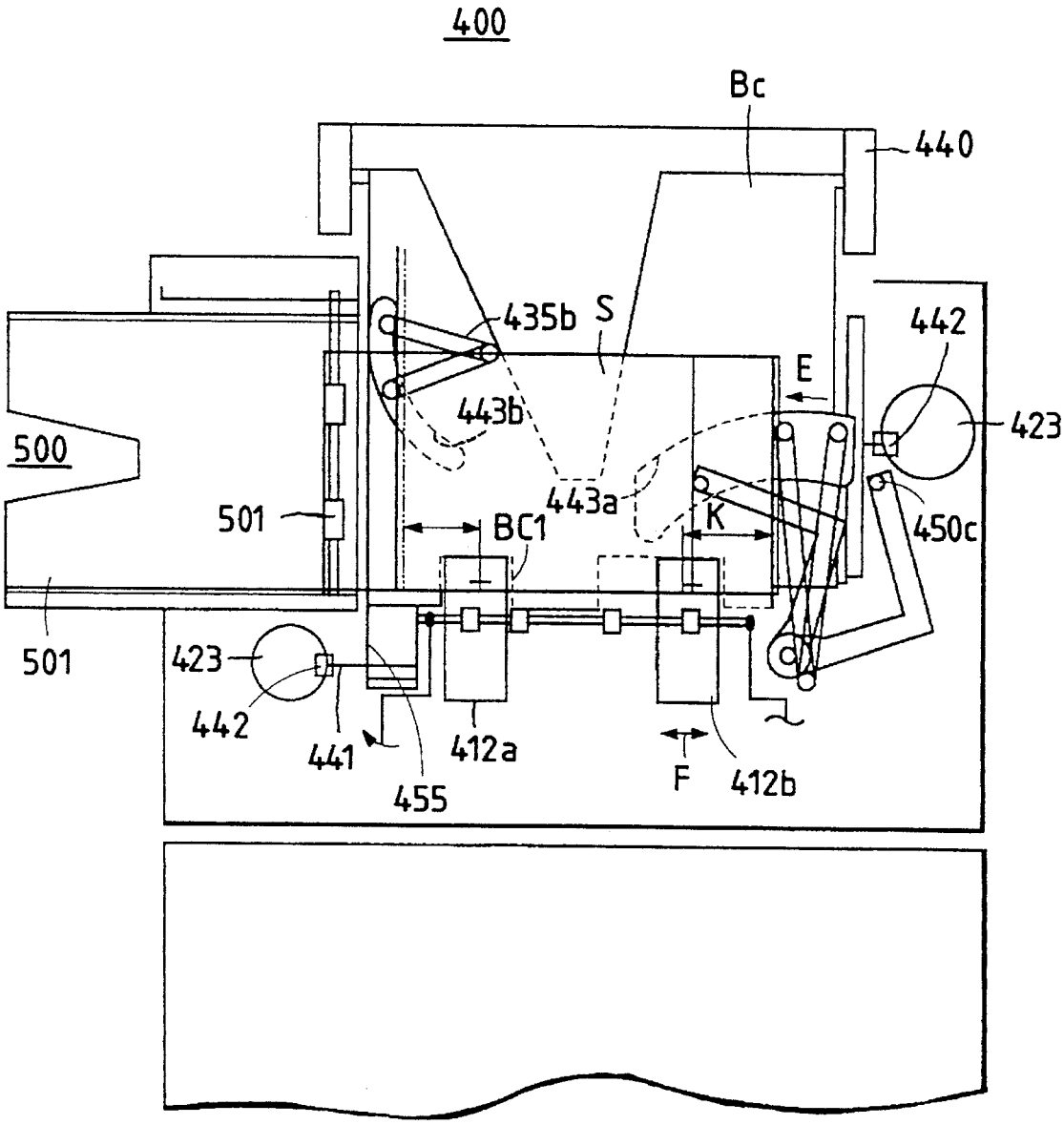
FIG. 7 is a view for explaining details of the arrangement of the sheet postprocessing apparatus in FIG. 1.

As illustrated in FIG. 7, engaging plates 440 are formed on the front and back sides of the distal end of the bin B. The distal end of the bin B is supported as the engaging plates 440 engage with support plates provided inside the frames 429.

Support shafts 441 are fixed on the front and back sides of the proximal end of the bin B. A roller 442 is pivotally supported by each support shaft 441.

In addition, elongated holes 443*a* and 443*b* are formed in the bin B at predetermined distances from shafts 437*a* and 436*b*, respectively. The elongated hole 443*a* is longer than the distance the matching rod 439*a* rotates and has a width much larger than the width of the matching rod 439*a*. The elongated hole 443*b* is longer than the distance the matching rod 439*b* rotates and has a width much larger than the width of the matching rod 439*b*.

A proximal end portion Ba of the bin B rises perpendicularly to a sheet storage surface Bb. The bin B is inclined a predetermined angle to the machine body 402 such that the distal end on the opposite side of the proximal end portion Ba is located above the proximal end portion Ba. With this inclination, the ejected sheets S slide on the sheet storage surface Bb, come in contact with the proximal end portion Ba, and are thereby matched in the ejecting direction. Notches BC1 and BC2 are formed in the bin B at portions into which the staplers 412*a* and 412*b* proceed. Therefore, the staplers 412*a* and 412*b* and the bin B do not interfere with each other. The matching rod 439*a* is inserted into the elongated holes 443*a* of the bins B1, B2, . . . , and pivoted in these elongated holes 443*a*, thereby matching the sheets S on the bins B by pushing the sheets forward.

Likewise, the matching rod 439*b* is inserted into the elongated holes 443*b* of the bins B1, B2, . . . , and pivoted in these elongated holes 443*b*, thereby matching the sheets S on the bins B by pushing the sheets backward. A groove 423*a* slightly wider than the roller 442 is spirally formed in the lead cam 423 and engaged with the roller 442. Therefore, the roller 442 is moved up and down along the groove 423*a* by the rotation of the lead cam 423.

Note that one rotation of the lead cam 423 is detected by a lead cam sensor S404 arranged near the lead cam 423. Also, the position of the bin unit 403 is detected by a bin home position sensor S405.

The presence of the sheet original S on the sort bin B can be detected by a sort tray paper detecting sensor (sheet postprocessing position detecting means) S407. As discussed above, the two electric staplers 412*a* and 412*b* for stapling the sheets S stored in the bin B are disposed near the pair of conveying rollers 411. These staplers 412*a* and 412*b* are disposed at positions at Which they are perpendicular to the conveying direction of the sheets S and capable of moving forward and backward. The staplers 412*a* and 412*b* normally escape to position I so as not to interfere with the vertical motion of the bin B. In stapling a bundle of sheets S on the bin B, the staplers 412*a* and 412*b* move to position II to staple the bundle of sheets S. The electric staplers 412*a* and 412*b* are so designed as to be independently movable.

After the stapling, these staplers are returned to the position I by driving means (not shown).

Each of the electric staplers 412*a* and 412*b* performs a staple operation upon rotation of a motor (not shown) and staples the sheets S on a plurality of bins B when the bins B are moved vertically.

In addition, since the two electric staplers 412*a* and 412*b* are provided, an operator can selectively operate one (one-point stapling) or both (two-point stapling) of the staplers. The selection of the staplers 412*a* and 412*b* will be described later. When a manual staple key S406 is depressed after sorting, a staple operation is performed. An L-shaped arm 450*b* is axially supported by a vertical shaft of the bin unit 403 on the back side of the sorter 400 such that the arm 450*b* is rotatable about the vertical shaft. A push rod extending downward is fixed to the distal end of the arm 450*b*. The arm 450*b* and the push rod constitute a pushing member. This pushing member is pivoted by driving means (not shown) to allow operations, such as pushing a bundle of sheets on a predetermined bin forward.

Figure 8:
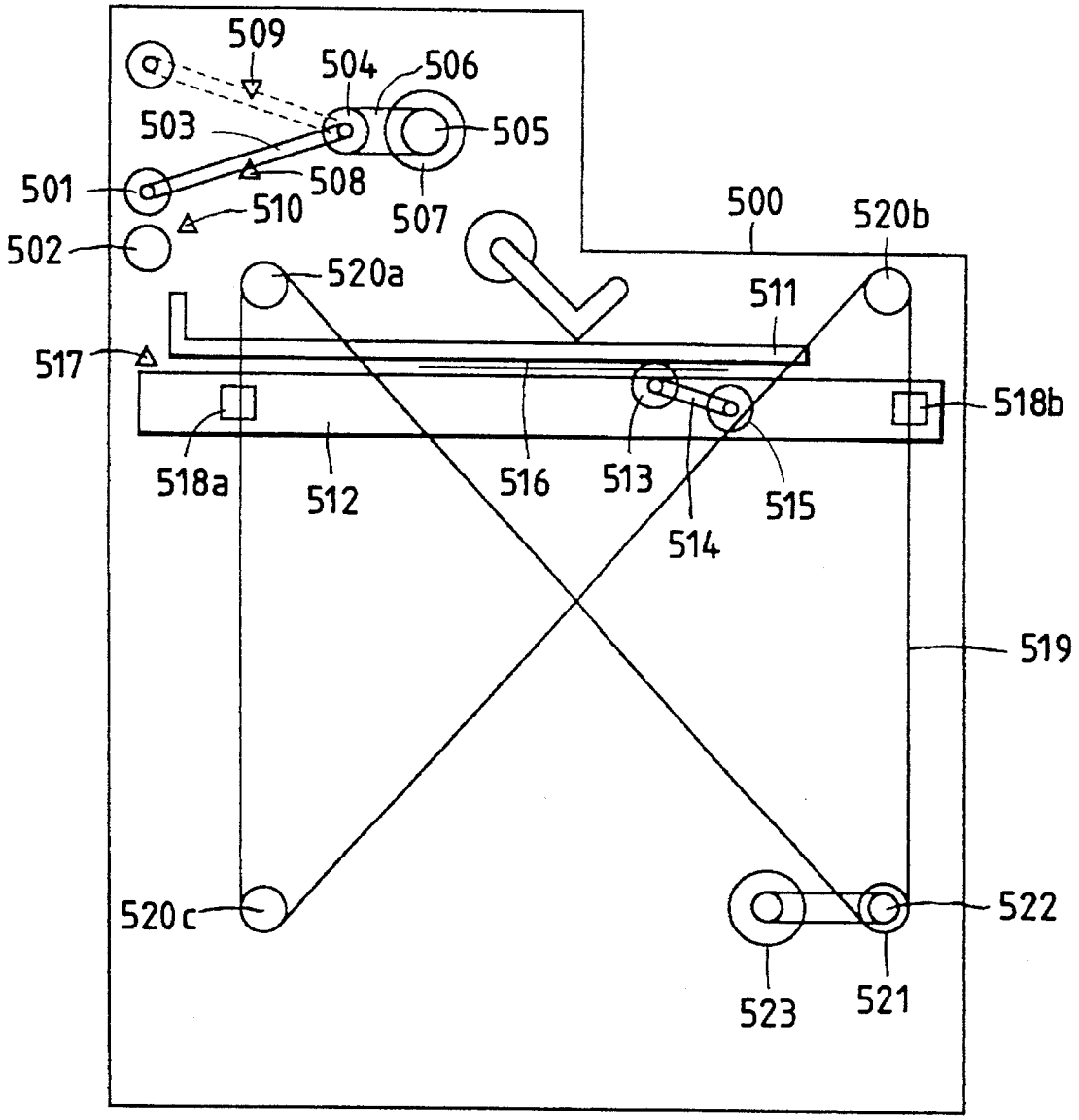
FIG. 8 is a view for explaining details of the arrangement of a sheet bundle stacking apparatus shown in FIG. 1.

FIG. 8 is a sectional view for explaining details of the arrangement of the sheet bundle stacking apparatus (stacker) 500 illustrated in FIG. 1.

In FIG. 8, bundle conveying rollers 501 and 502 convey a bundle of sheets received from the sheet postprocessing apparatus 400. The bundle conveying rollers 501 and 502 are supported by a swing arm 503 so as to be brought into rolling contact with each other. The swing arm 503 is vertically swung by an arm swing motor 507 via pulleys 504 and 505 and a timing belt 506. The position of the swing arm 503 indicated by the solid lines in FIG. 8 is a conveying position for conveying a sheet bundle. This conveying position is detected by a bundle conveying position sensor 508. The position indicated by the broken lines in FIG. 8 is a receiving position for receiving a sheet bundle. This receiving position is detected by a bundle receiving position sensor 509. The bundle conveying roller 502 is driven to convey a bundle of sheets by a bundle conveying motor. Note that this bundle conveying motor has an encoder and thereby can measure the moving amount. A bundle detecting sensor 510 detects a sheet bundle conveyed by the bundle conveying rollers. A bundle stacking tray 511 is supported by a tray support table 512. A tray moving motor 515 moves the bundle stacking tray 511 via a timing belt 514, a pulley/pinion gear 513, and a rack 516. The tray moving motor 515 has an encoder (not shown) and thereby can measure the moving amount. A tray home position sensor 517 detects the home position of the bundle stacking tray 511. The position of the bundle stacking tray 511 is detected by an output from the tray home position sensor 517 and an output from the encoder of the tray moving motor 515. The tray support table 512 is fastened to a wire 519 by fasteners 518*a* and 518*b*.

The wire 519 is looped between pulleys 520*a*, 520*b*, and 520*c*, and a driving pulley 521. A driving shaft 522 of the driving pulley 521 is driven to vertically move the tray support table 512 by a tray lifting motor 523. The driving shaft 522 is connected to a driving pulley (not shown) on the rear surface side, and a tray lifting mechanism using a wire is also provided on this side. Consequently, the tray support table 512 is supported at four points. A sheet bundle stacking operation of the sheet bundle stacking apparatus 500 will be described below with reference to FIG. 9.

Figure 9:
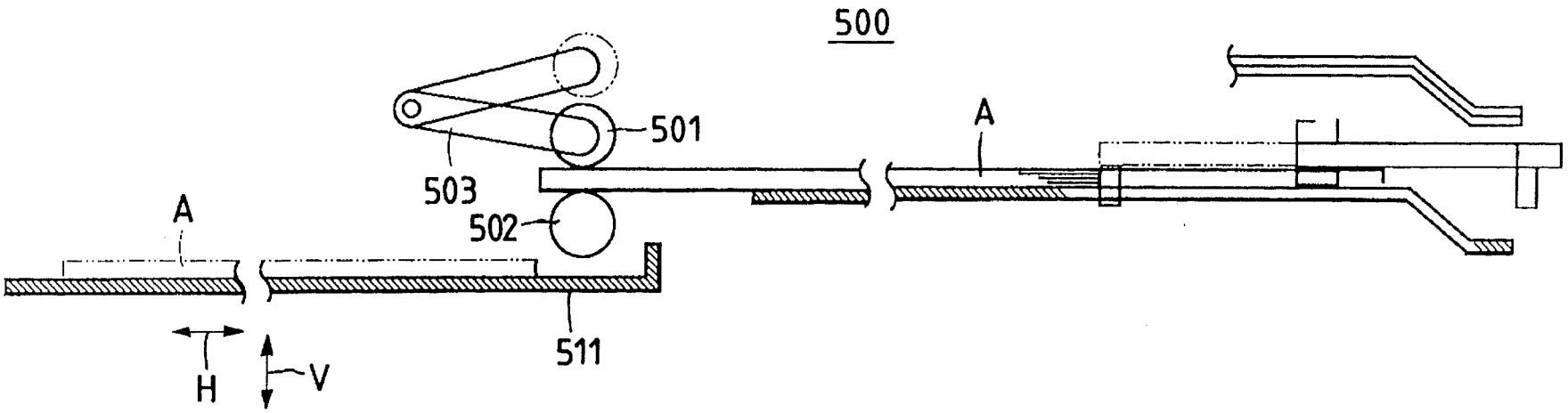
FIG. 9 is an enlarged sectional view showing the major components of the sheet bundle stacking apparatus in FIG. 8.

FIG. 9 is an enlarged sectional view of the main parts of the sheet bundle stacking apparatus 500 illustrated in FIG. 8.

As shown in FIG. 9, when the sensor 510 detects insertion of a sheet bundle A, the arm swing motor 507 starts rotating. This rotation gradually closes the opening between the upper swing arm 503 and the lower swing arm, clamping the sheet bundle A between the upper and lower conveying rollers 501 and 502. Upon application of an appropriate pressure to between the upper and lower conveying rollers 501 and 502, the arm swing motor 507 stops, and the bundle conveying motor is activated. The bundle conveying motor rotates the upper and lower conveying rollers 501 and 502 at an equal speed to Convey the sheet bundle A. When the sensor 510 detects the trailing end of the sheet bundle A, the rotation of the bundle conveying motor is stopped. Subsequently, the arm swing motor 507 is rotated to release the pressure between the upper and lower conveying rollers 501 and 502. The tray moving motor 515 is activated in the state in which the trailing end of the sheet bundle A being conveyed is in contact with the lower conveying roller 502 and the leading end is in contact with the bundle stacking tray 511. Consequently, the bundle stacking tray 511 is moved in the conveying direction. The tray moving motor 515 is stopped after the sheet bundle A is ejected. This allows offsetting of the sheet bundle A on the bundle stacking tray. The height of the tray support table 512 is controlled by driving the tray lifting motor 523 on the basis of an input from a paper surface detecting sensor.

Figure 10:
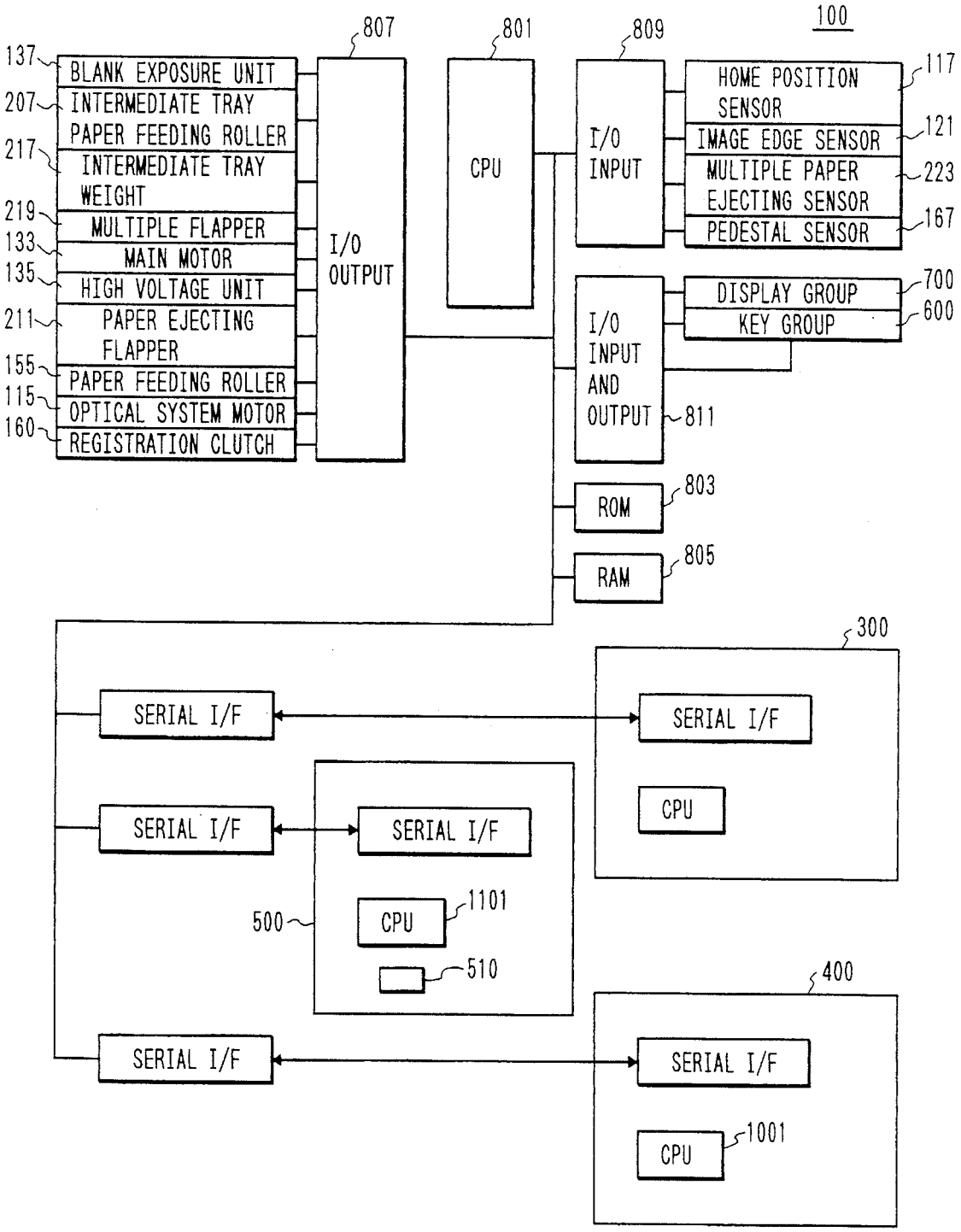
FIG. 10 is a block diagram for explaining the control configuration of the image forming system in FIG. 1.

FIG. 10 is a block diagram for explaining the control configuration of the image forming system shown in FIG. 1.

Referring to FIG. 10, a central processing unit (CPU) 801 is constituted by, e.g., a microcomputer V50 (tradename) available from NEC Corp. The CPU 801 generally controls the main body 100, the RDF 300, the sorter 400, and the stacker 500 in accordance with the control procedures (including the procedures of the flow charts to be described later) stored in a ROM 803.

A RAM 805 is a main memory used to store input data or as a work area. An interface (I/O) 807 outputs control signals from the CPU 801 to loads such as a main motor 133. An interface 809 receives an input signal from, e.g., the sensor 121 and transfers the signal to the CPU 801. An interface 811 controls input/output of a key group 600 and a display group 700. These interfaces 807, 809, and 811 are constituted by, e.g., input circuit ports (μPD8251) (tradename)) manufactured by NEC Corp. A known communication IC (e.g., a communication IC (μPD8251) manufactured by NEC Corp.) is also connected through a bus. This communication IC is connected to communication ICs of the RDF 300 and the sorter 400. These ICs exchange control data required for mutual control between the main body 100, the RDF 300, and the sorter 400 through communications.

The data transmitted from the main body 100 to the RDF 300 includes a paper feed signal for instructing feeding of originals stacked on the RDF 300, a paper eject signal for instructing ejection of an original on the platen glass 101, and a paper feed/eject mode for determining a form of feed/eject of originals including a reserved original. The data transmitted from the main body 100 to the sorter 400 includes, e.g., an image formation mode, a mode for storage in the sorter 400, a sheet size to be stored, and a timing signal. A registration clutch 160 is also illustrated in FIG. 10.

In the image forming system with the above arrangement, on the basis of an image formation mode set by the image formation mode setting means (the key group 600), the staple mode setting means (the CPU 801, a CPU 1001) automatically sets a first staple mode (for performing two-point stapling) regardless of whether the staple mode selecting means (the staple mode select keys 640*a* and 640*b* discussed before) selects a staple mode. Consequently, bookbinding is performed for a bundle of sheets without causing any staple designation error.

In addition, the presence/absence of stapling materials (needles) in each of the stapling means (the staplers 412*a* and 412*b* of the sheet postprocessing apparatus 400) is checked. In accordance with the check result, the first switching means (the CPU 1001) enables or disables the first staple mode set by the staple mode setting means (the CPU 801), thereby avoiding an event in which stapling is impossible.

Furthermore, the staple mode setting means (the CPU 801) automatically sets the first staple mode if the image formation mode setting means sets a both-side mode or both sides mode in which images are formed on both of the upper and lower surfaces of a sheet material. After both-side image formation is performed for sheet materials, bookbinding is automatically performed.

Also, the staple mode setting means (the CPU 801) automatically sets the first staple mode if the image formation mode setting means sets a cover mode, in which a cover is added to a bundle of sheets, as the image formation mode. After a cover is added to sheet materials, bookbinding is automatically performed.

If the first switching means (the CPU 1001) disables the first staple mode set by the staple mode setting means (the CPU 801) by checking the presence/absence of stapling materials in each of the bundle stapling means (the staplers 412*a* and 412*b* of the sheet postprocessing apparatus 400), the second switching means (the CPU 1001) enables the first staple mode which is disabled by checking the state of the staple mode selection by the staple mode selecting means (the staple mode select keys 640*a* and 640*b* discussed earlier). Consequently, a user can switch the state of the staple processing from the disable to the enable state.

If the first switching means (the CPU 1001) enables the first staple mode set by the staple mode setting means (the CPU 801) by checking the presence/absence of stapling materials in each of the stapling means (the staplers 412*a* and 412*b* of the sheet postprocessing apparatus 400), a second staple mode (for performing one-point stapling) which is selected by a user is enabled, instead of the first staple mode that is automatically set, by the staple mode selecting means (the staple mode select keys 640*a* and 640*b*). This allows the user to perform staple processing other than bookbinding.

Note that the CPU 801 and the CPU 1001 control staple processing at two points (bookbinding processing) and the like performed by the staplers 412*a* and 412*b* of the sheet postprocessing apparatus 400 in accordance with flow charts illustrated in FIGS. 18 and 20 (to be described later) stored in the ROM 803.

Figure 11:
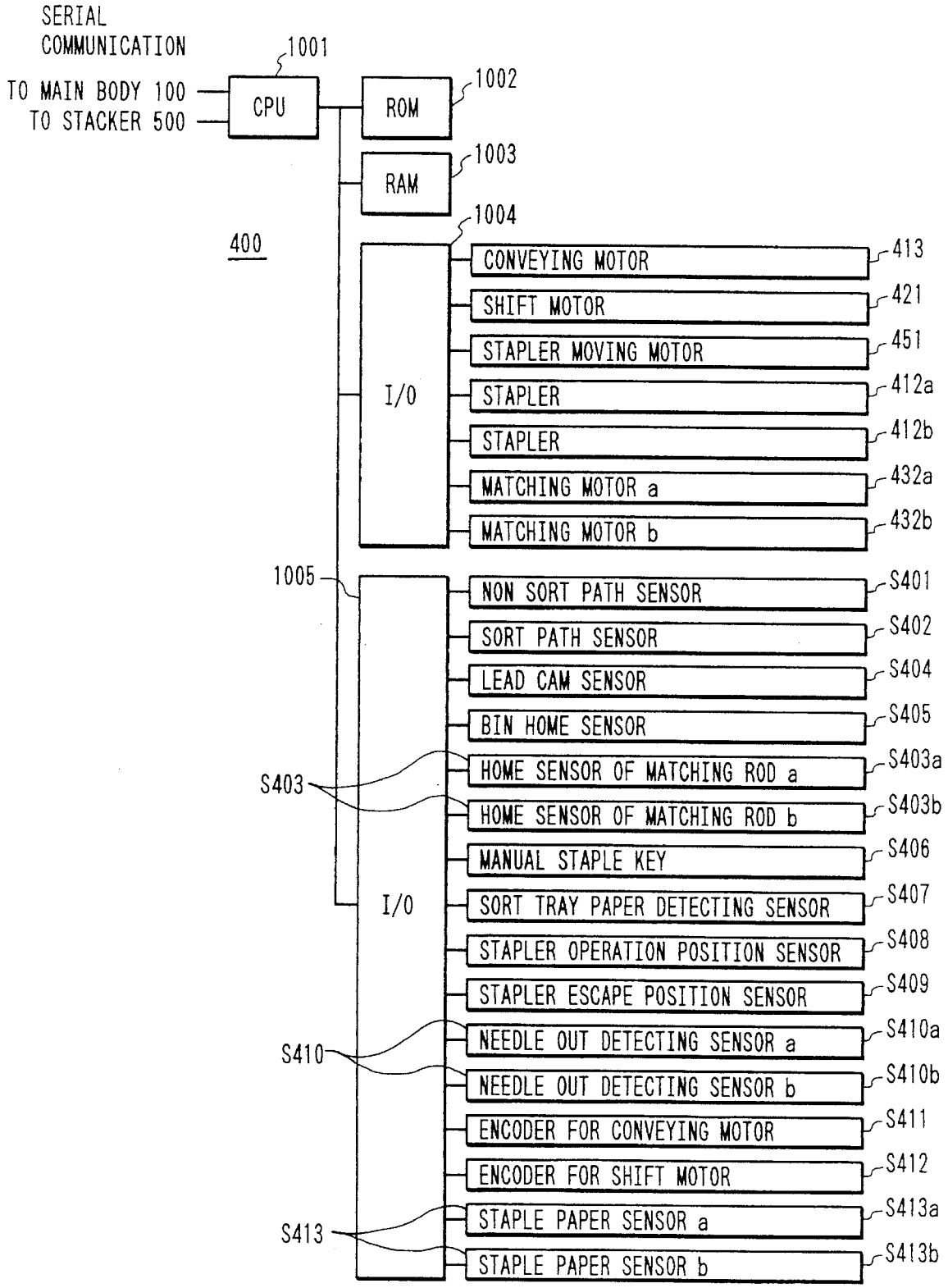
FIG. 11 is a block diagram for explaining the control configuration of a sorter shown in FIG. 10.

FIG. 11 is a block diagram for explaining the control configuration of the sorter 400 shown in FIG. 10.

As in FIG. 11, the CPU 1001 processes various sensor inputs to an input port 1005 on the basis of the control programs stored in a ROM 1002, thereby controlling devices connected to an output port 1004. A RAM 1003 primarily functions as a work memory of the CPU 1001. The RAM 1003 also stores input data and work data. The output port 1004 is connected to various motors such as a shift motor 421. The input port 1005 is connected to sensors S402 to S413, including the non-sort path sensor S401, and switches.

The CPU 1001 has a serial interface function. With this function the CPU 1001 performs serial communication with the CPU of the main body 100 or of the stacker 500, controlling the individual parts by signals from the main body or outputting an operation signal to the stacker. Note that the sensors S403, S410, and S413 include sensors S403*a*, S403*b*, S410*a*, S410*b*, S413*a*, and S413*b*.

Figure 12:
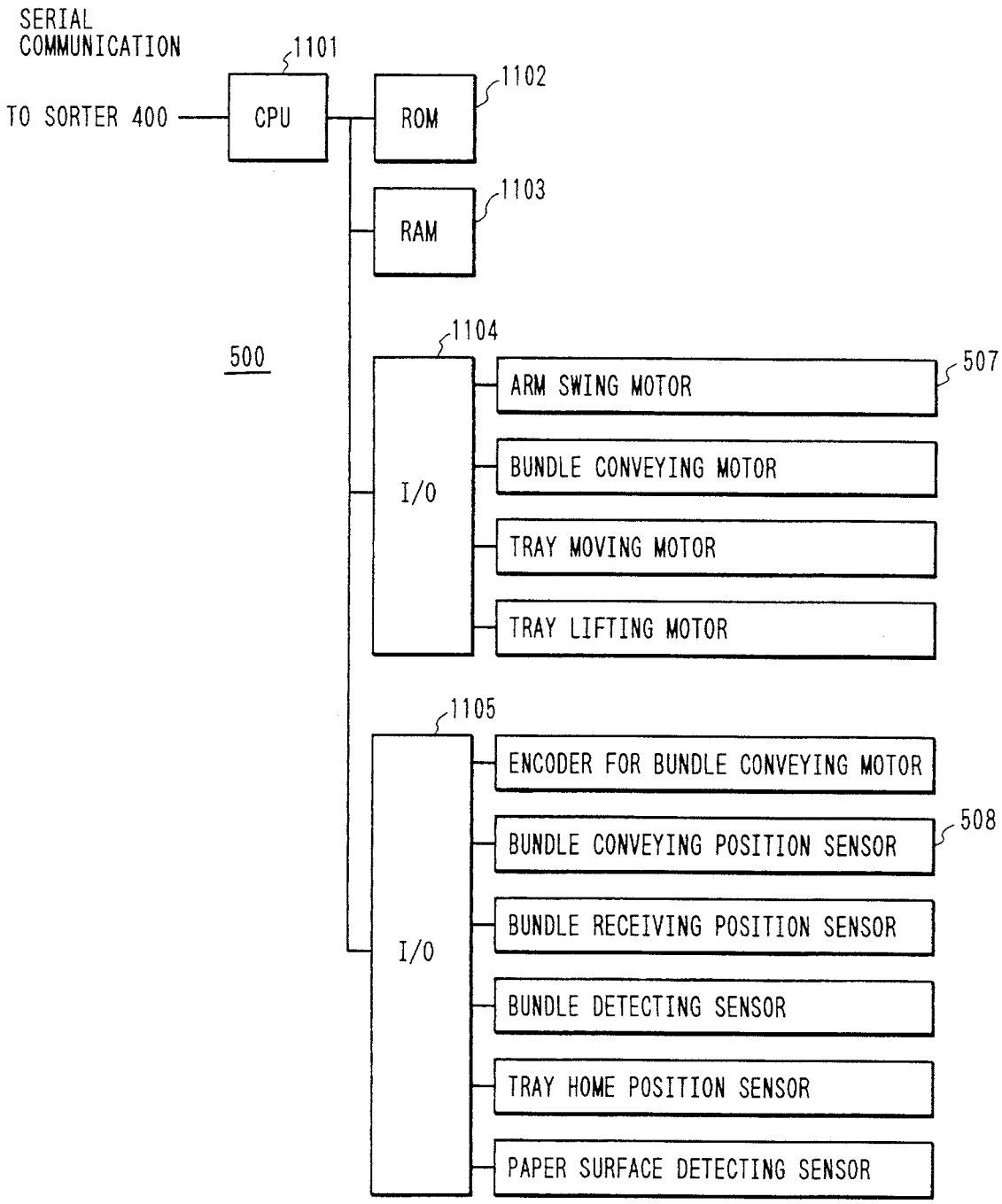
FIG. 12 is a block diagram for explaining the control configuration of a stacker shown in FIG. 10.

FIG. 12 is a block diagram for explaining the control configuration of the stacker 500 illustrated in FIG. 10.

As in FIG. 12, a CPU 1101 controls the individual devices connected to an output port 1104 by processing various sensor inputs to an input port 1105 on the basis of the control programs stored in a ROM 1102. A RAM 1103 primarily functions as a work memory of the CPU 1101. The RAM 1103 also stores input data and work data. The output port 1104 is connected to various motors such as the arm swing motor 507 discussed above. The input port 1105 is connected to various sensors such as the bundle conveying position sensor 508. The CPU 1101 controls the individual parts connected through a bus in accordance with the control programs stored in a ROM 1102. In addition, the CPU 1101 has a serial interface function and with this function performs serial communication with the CPU 1001 of the sorter 400, controlling the individual components by signals from the sorter 400.

The image formation processing of the image forming system according to the present invention will be described below with reference to the flow charts shown in FIGS. 13 to 24.

Figure 13:
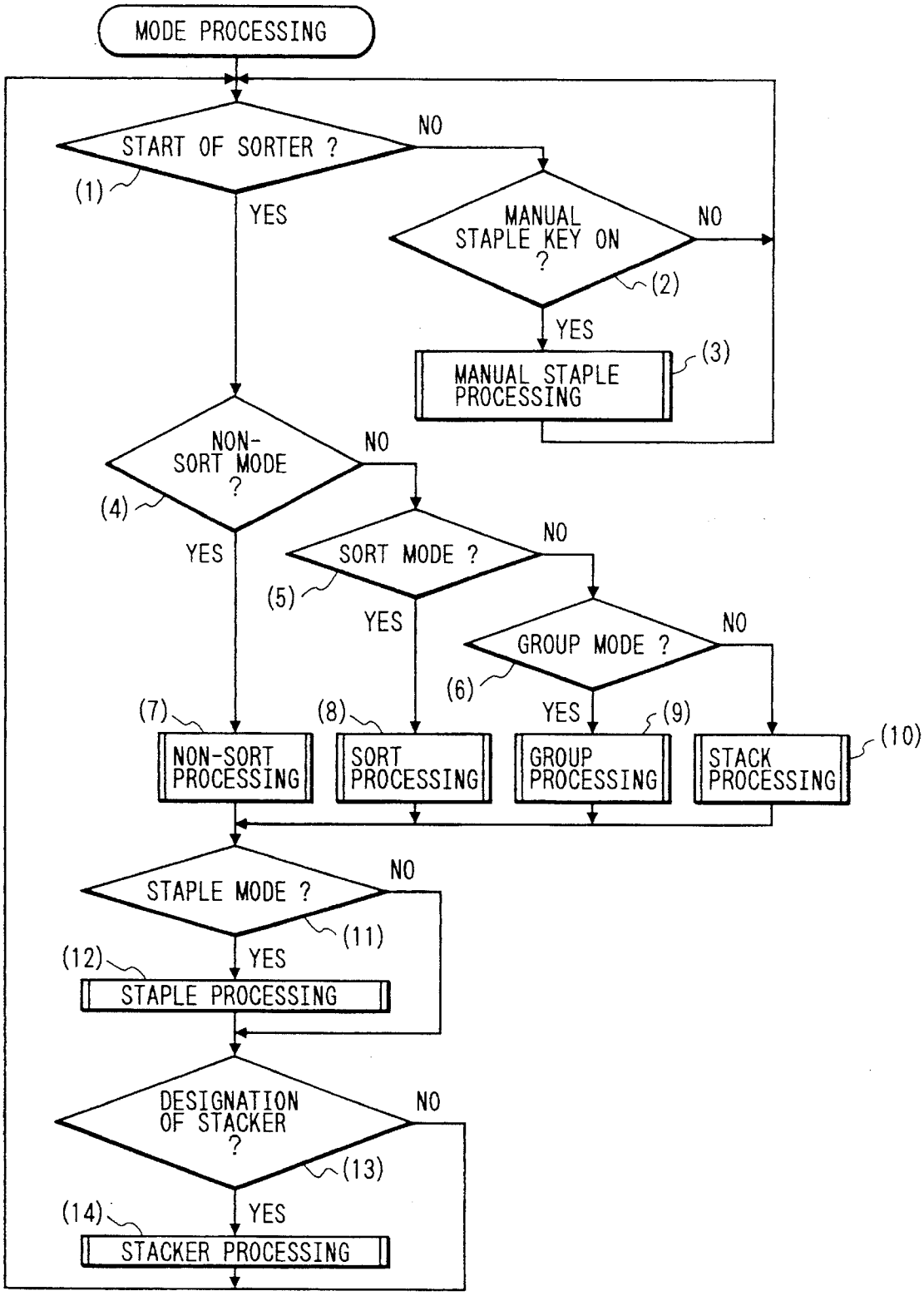
FIG. 13 is a flow chart showing a practical example of the image formation mode procedure of the image forming system according to the present invention.

FIG. 13 is a flow chart showing a practical example of the procedure performed by the sorter 400 of the image forming system according to the present invention. In FIG. 13, numerals (1) to (14) indicate the step numbers.

First, the CPU 1001 checks whether the main body 100 has transmitted a sorter start signal indicative of start of sheet ejection (1). If NO in step (1), the CPU 1001 checks whether the manual staple key S406 is ON (2). If NO in step (2), the flow returns to step (1). If YES in step (2), the CPU 1001 executes a manual staple=processing routine to be described later (3).

On the other hand, if YES in step (1), the CPU 1001 checks the mode of storage of sheets ejected from the main body 100. First, the CPU 1001 checks whether a non-sort mode is set (4). If YES in step (4), the CPU 1001 executes a non-sort processing routine to be described later (7). If NO in step (4), the CPU 1001 checks whether a sort mode is set (5). If YES in step (5), the CPU 1001 executes a sort processing routine to be described later (8). If NO in step (5), the CPU 1001 checks whether a group mode is set (6). If NO in step (6), the CPU 1001 executes a stack processing mode to be described later (10). If YES in step (6), the CPU 1001 executes a group processing routine to be described later (9).

Subsequently, the CPU 1001 checks whether a staple mode is set (11). If NO in step (11), the flow advances to step (13). If YES in step (11), the CPU executes a staple processing routine to be described later (12). The CPU 1001 then checks whether designation of the stacker is present (13). If NO in step (13), the flow returns to step (1). If YES in step (13), the CPU 1001 executes a stacker processing routine (14) and completes the processing.

Figure 14:
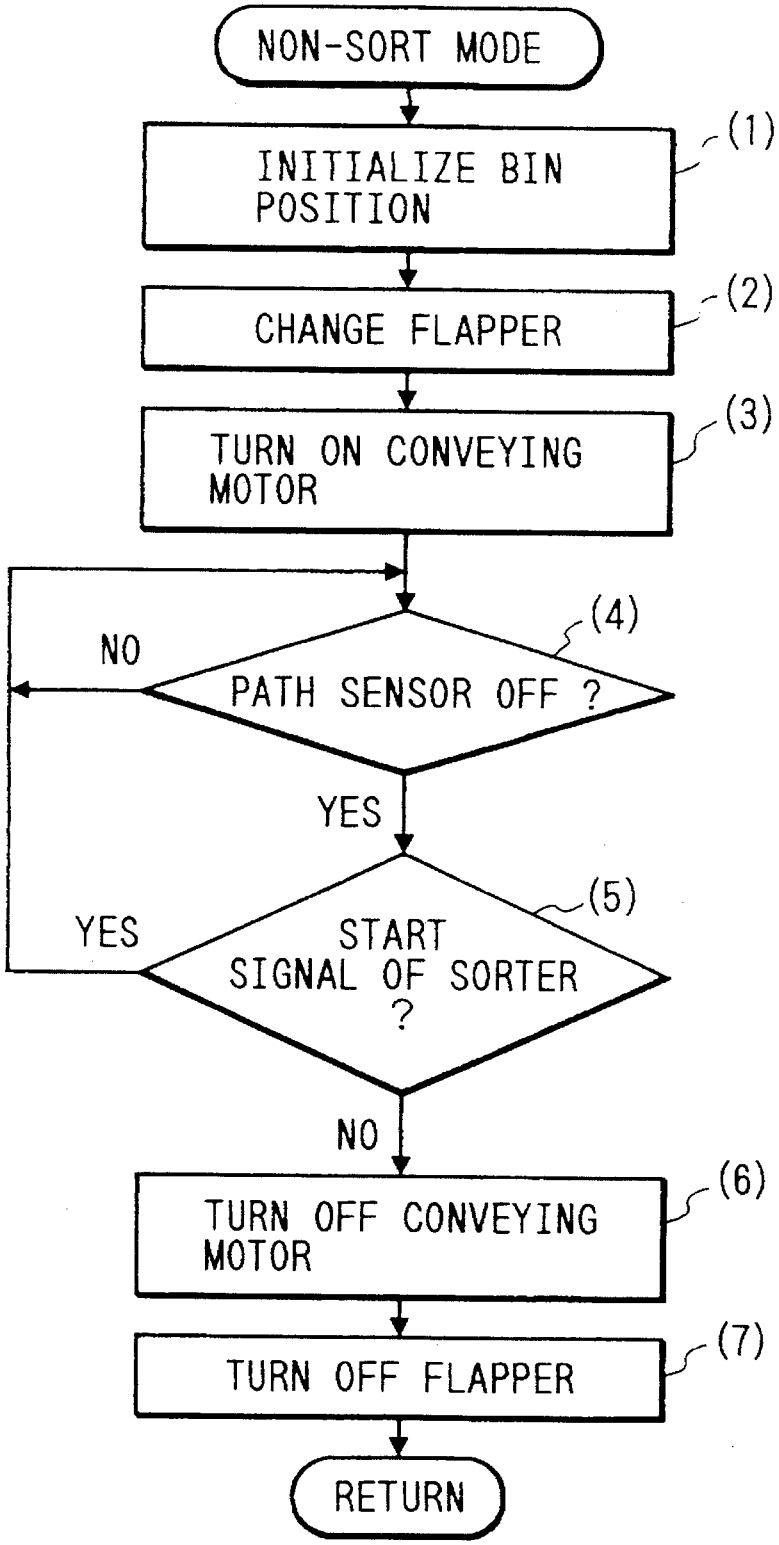
FIG. 14 is a flow chart showing details of the procedure of a non-sort processing routine in FIG. 13.

FIG. 14 is a flow chart showing details of the procedure of the non-sort processing routine depicted in FIG. 13. In FIG. 14, numerals (1) to (7) represent the step numbers.

First, to store sheets on the uppermost bin, the CPU 1001 moves the bin unit 403 down to the non-sort home position as initialization of the bins (1). The CPU 1001 then changes the position of the flapper 409 to select the conveying path 406 as a path for conveying sheets inside the sorter (2). This flapper 409 is connected to a driving solenoid (not shown) for switching the position of the flapper. The driving solenoid is normally OFF, in which case the conveying path 407 is selected. When the solenoid is turned on, the conveying path 406 is chosen. Subsequently, the CPU 1001 turns on the conveying motor (3) and checks ON/OFF of the path sensor S401 (4). If the path sensor S401 is OFF, the CPU 1001 checks whether a sorter start signal is transmitted (5). If YES in step (5), the flow returns to step (4). If NO in step (5), the CPU 1001 turns off the conveying motor (6), turns off the driving solenoid of the flapper 409 (7), and completes the non-sort processing.

Figure 15:
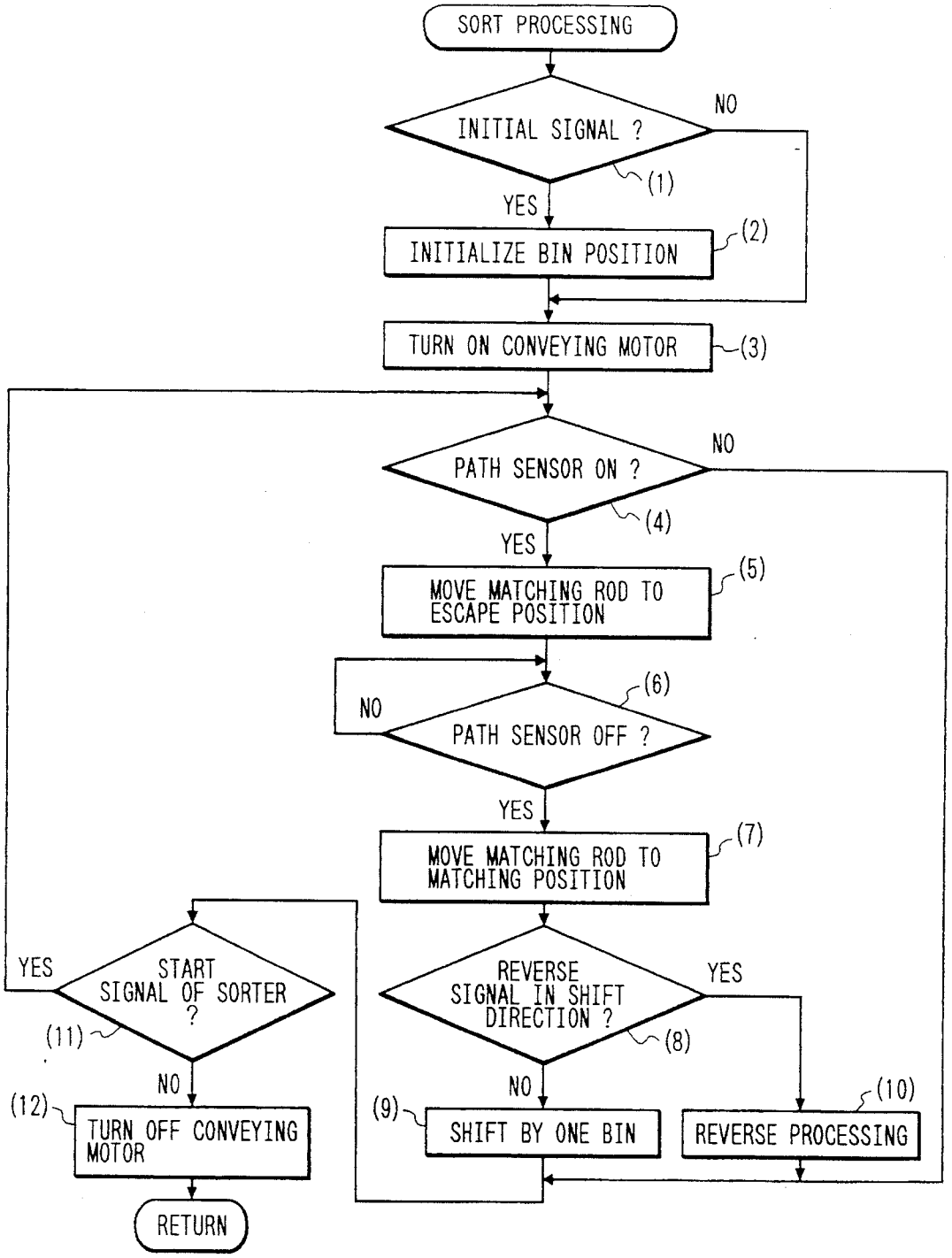
FIG. 15 is a flow chart showing details of the procedure of a sort processing routine in FIG. 13.

FIG. 15 is a flow chart showing details of the procedure of the sort processing routine shown in FIG. 13. In FIG. 15, numerals (1) to (12) indicate the step numbers.

To begin with, the CPU 1001 checks whether a bin initial signal for starting storage of sheets from the uppermost bin is transmitted (1). If NO in step (1), the flow advances to step (3). If YES in step (1), the CPU 1001 moves the bin unit 403 down to the non-sort home position as initialization of the bins (2). The CPU 1001 then turns on the conveying motor (3) and checks ON/OFF of the path sensor S402 (4). If NO in step (4), the flow advances to step (11). If YES in step (4), the CPU 1001 moves the matching rod to the escape position to perform a matching operation for ejected sheets later (5). Thereafter, upon detecting OFF of the path sensor S402 (6), the CPU 1001 performs a sheet matching operation (7). Subsequently, the CPU 1001 checks whether a bin shift direction reverse signal is transmitted (8). If NO in step (8), the CPU 1001 executes a shift by one bin (9). If YES in step (8), the CPU 1001 performs reverse processing (10). In this reverse processing, the shift direction for the subsequent bins is reversed, and no bin shift operation is performed. The CPU 1001 then checks whether the sorter start signal is ON (11). If YES in step (11), the flow returns to step (4). If NO in step (11), the CPU 1001 turns off the conveying motor (12) to complete the processing.

Figure 16:
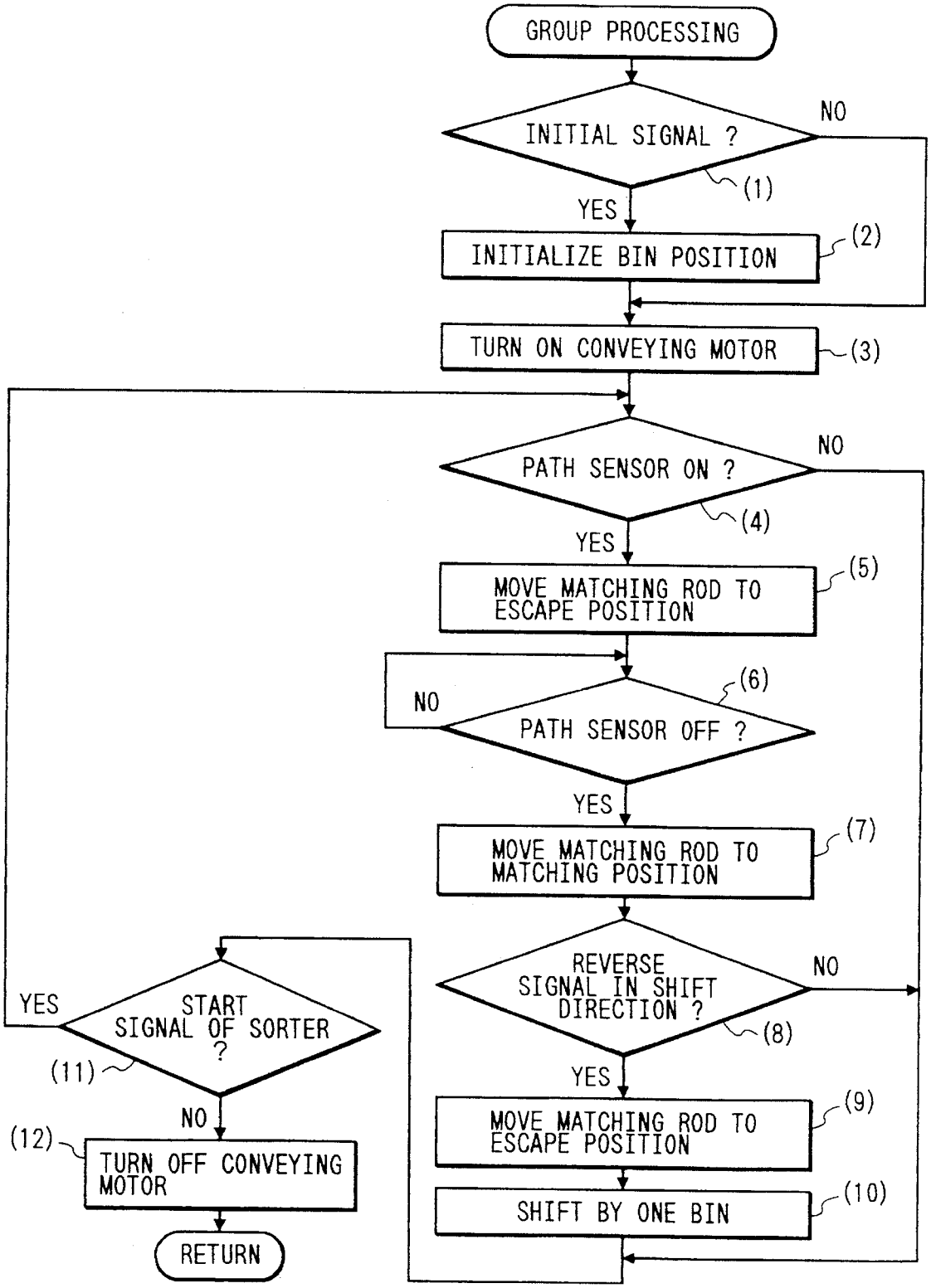
FIG. 16 is a flow chart showing details of the procedure of a group processing routine in FIG. 13.

FIG. 16 is a flow chart showing details of the procedure of the group processing routine illustrated in FIG. 13. In FIG. 16, numerals (1) to (12) indicate the step numbers.

First, the CPU 1001 checks whether a bin initial signal for starting storage of sheets from the uppermost bin is transmitted (1). If NO in step (1), the flow advances to step (3). If YES in step (1), the CPU 1001 moves the bin unit 403 down to the non-sort home position as initialization of the bins (2). Subsequently, the CPU 1001 turns on the conveying motor (3) and checks ON/OFF of the path sensor S402 (4). If the path sensor S402 is OFF, the flow advances to step (10). If the path sensor S402 is ON, the CPU 1001 moves the matching rods **439*a* and 439*b* to the escape position to perform a matching operation for ejected sheets later (5). Thereafter, when the path sensor S402 is turned off (6), the CPU 1001 moves the matching rod 439*a* to the matching position (7), performing a matching operation for the sheets. The CPU 1001 then checks whether a bin Shift direction reverse signal is transmitted (8). If NO in step (8), the flow advances to the steps after step (10). If YES in step (8), the CPU 1001 move is the matching rod 439*a* to the escape position (9) and executes a shift by one bin (10). Subsequently, the CPU 1001 checks whether a sorter start signal Us transmitted (11). If YES in step (11), the flow returns to step (4). If NO in step (11), the CPU 1001 stops (turns off) the conveying motor (12**) to complete the processing.

Figure 17:
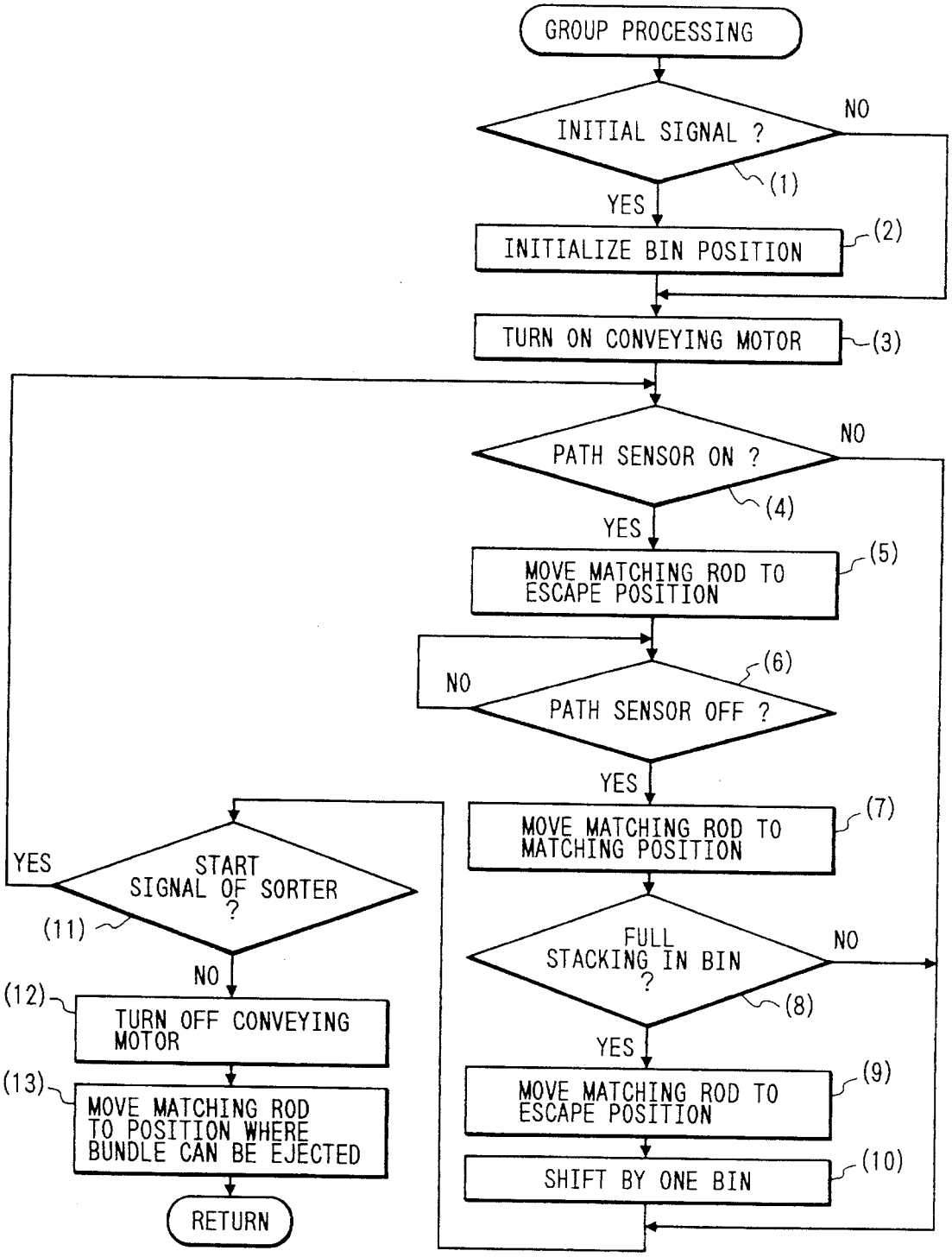
FIG. 17 is a flow chart showing details of the procedure of a stack processing routine in FIG. 13.

FIG. 17 is a flow chart showing details of the procedure of the stack processing routine in FIG. 13. In FIG. 17, numerals (1) to (13) represent the step numbers.

The CPU 1001 first checks whether a bin initial signal for starting storage of sheets from the uppermost bin is transmitted (1). If NO in step (1), the flow advances to step (3). If YES in step (1), the CPU 1001 moves the bin unit 403 down to the non-sort home position as initialization of the bins (2). The CPU 1001 then turns on the conveying motor (3) and checks ON/OFF of the path sensor S402 (4). If the path sensor S402 is OFF, the flow advances to the steps after step (10). If the path sensor S402 is ON, the CPU 1001 moves the matching rods **439*a* and 439*b* to the escape position to perform a matching operation for ejected sheets later (5). Thereafter, when the path sensor S402 is turned off (6), the CPU 1001 moves the matching rod 439*a* to the matching position (7), performing a matching operation for the sheets. Subsequently, the CPU 1001 checks whether the number of sheets stored in the bin presently being used has reached an upper-limit number (8). If NO in step (8), the flow advances to the steps after step (10). If YES in step (8), the CPU 1001 moves the matching rod 439*a* to the escape position (9) and executes a shift by one bin (10). The CPU 1001 then checks whether a sorter start signal is transmitted (11). If YES in step (11), the flow returns to step (4). If NO in step (11), the CPU 1001 stops (turns off) the conveying motor (12) and moves the matching rod 439*a* to the bundle ejectable position to prepare for bundle ejection (13**), completing the processing.

Figure 18:
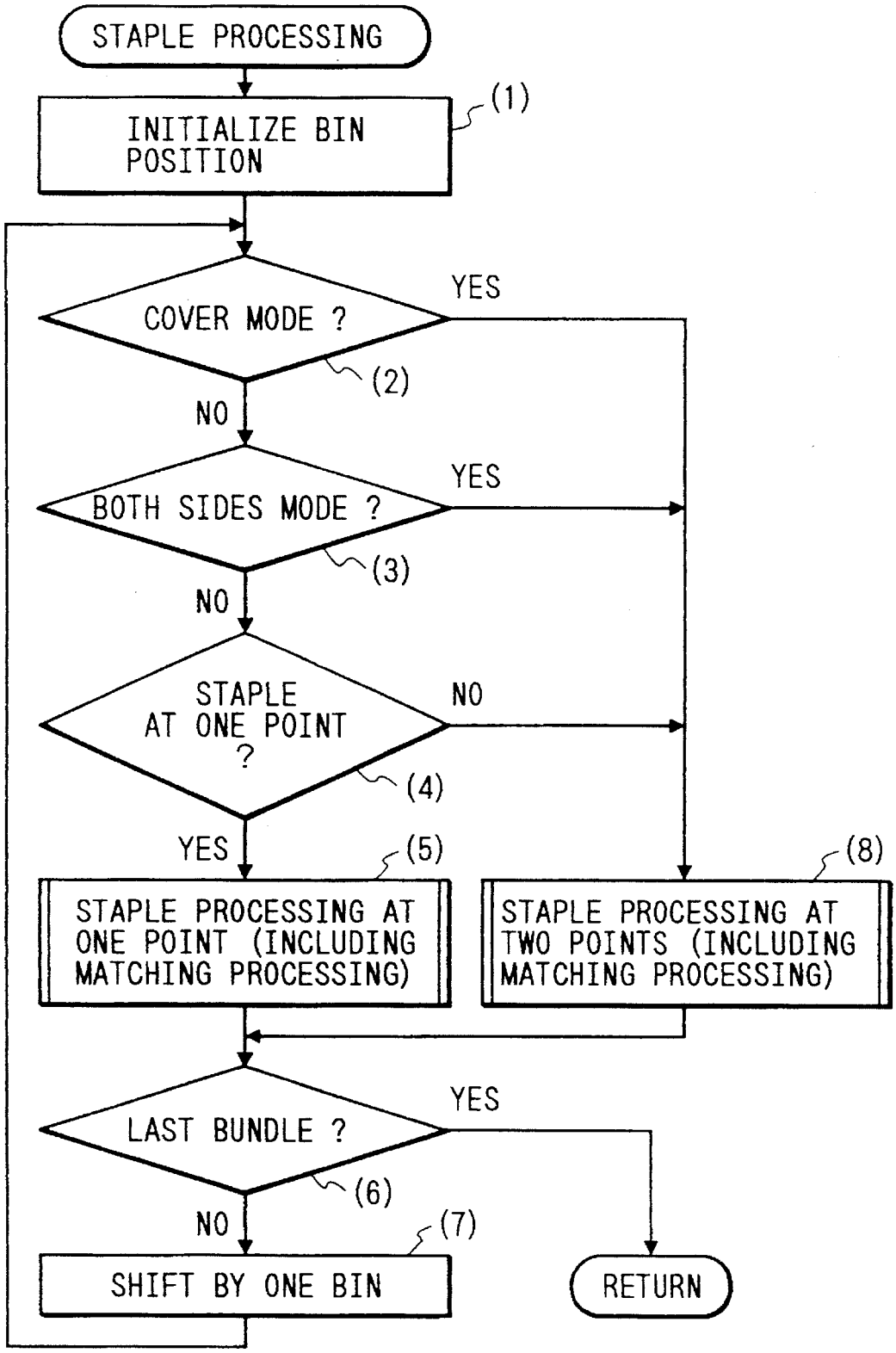
FIG. 18 is a flow chart showing details of the procedure of a staple processing routine in FIG. 13.

FIG. 18 is a flow chart showing details of the procedure of the staple processing routine in FIG. 13. In FIG. 18, numerals (1) to (8) indicate the step numbers.

First, the CPU 1001 initializes the bin position to perform a series of staple processing operations (1). The bin position to be initialized is one which is the uppermost or lowermost of usable bins and closest to the bin position currently being used. Upon completing the movement, the CPU 1001 sets a downward shift as the shift direction if the initialized bin position is the uppermost one, and sets an upward shift if the bin position is the lowermost one.

Subsequently, the CPU 1001 checks whether a cover mode is set (2). If YES in step (2), the flow advances to step (8), and the CPU 1001 executes two-point binding processing (staple processing at two points). Thereafter, the flow advances to step (6).

On the other hand, if NO in step (2), the CPU 1001 checks whether a both sides mode is set (3). If YES in step (3), the CPU 1001 executes the two-point binding processing (staple processing at two points), and the flow advances to step (6).

If NO in step (3), the CPU 1001 checks whether a staple mode (which is designated by staple mode data transmitted from the main body by serial communication) indicates one point or two points (4). If the CPU 1001 determines staple at one point in step (4), the CPU 1001 executes staple processing at one point (5), and the flow advances to step (6).

If, on the other hand, the CPU 1001 determines staple at two points in step (4), the CPU 1001 executes the staple processing at two points (8). The CPU 1001 then checks whether the stapled bundle is the last bundle in a series of the staple processing operations (6). If YES in step (6), the CPU 1001 completes the processing. If NO in step (6), the CPU 1001 executes a shift by one bin (7), and the flow returns to step (2).

Figure 19:
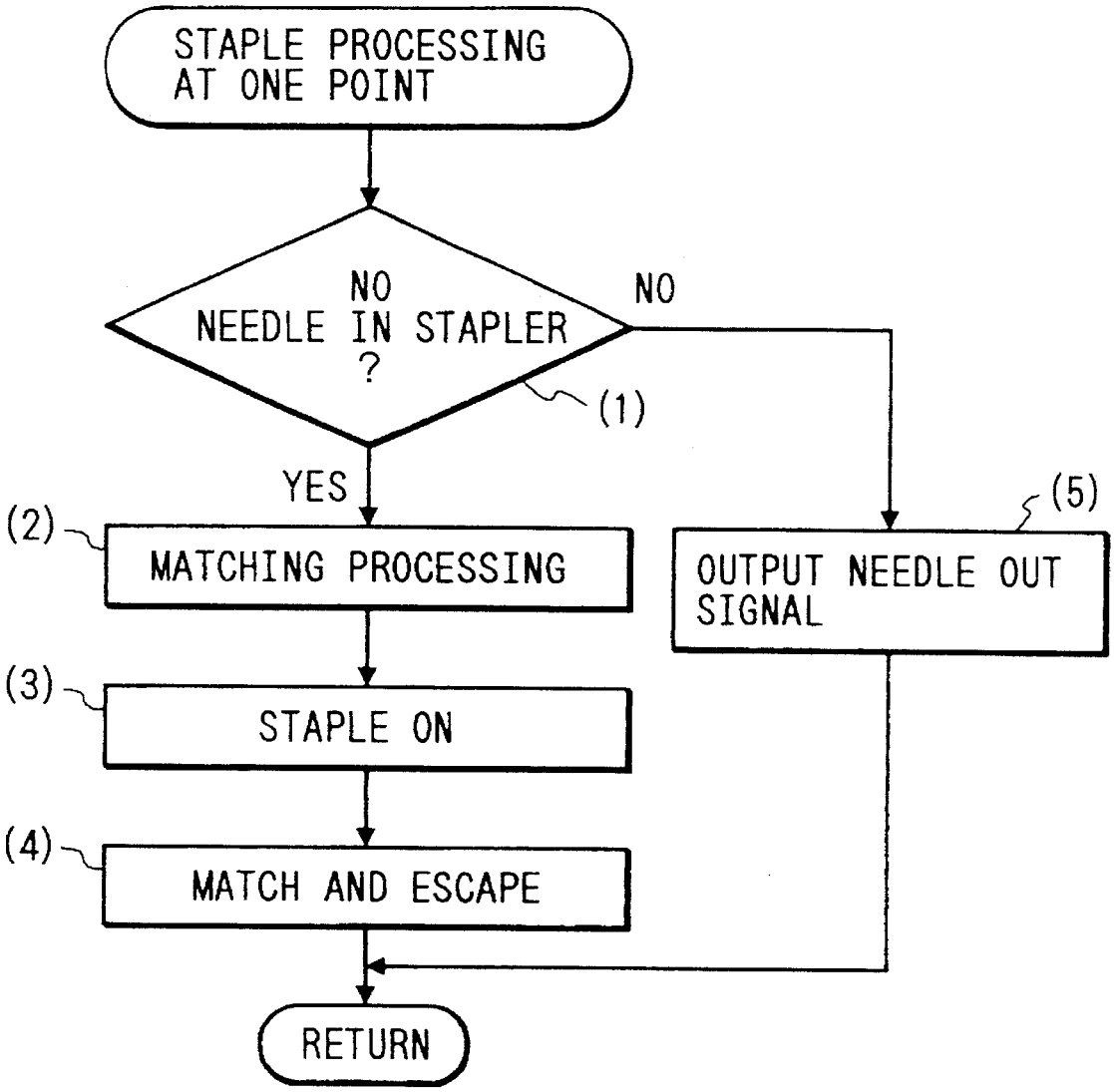
FIG. 19 is a flow chart showing a detailed procedure of the routine of staple processing at one point shown in FIG. 18.

FIG. 19 is a flow chart showing a detailed procedure of the routine of the staple processing at two points illustrated in FIG. 18. In FIG. 19, numerals (1) to (5) indicate the step numbers. Note that the stapler 412*a* is used in the one-point binding.

The CPU 1001 first checks from an output of the detecting sensor S410*a* whether any needle is available in the stapler 412*a* (1). If YES in step (1), the CPU 1001 executes matching processing (2) in which a bundle is pushed by the matching rod 439*a* to prevent mismatching of the bundle. The CPU 1001 then turns on stapling (3), makes the matching rod 439*a* escape (4), and completes the processing.

Figure 25A:
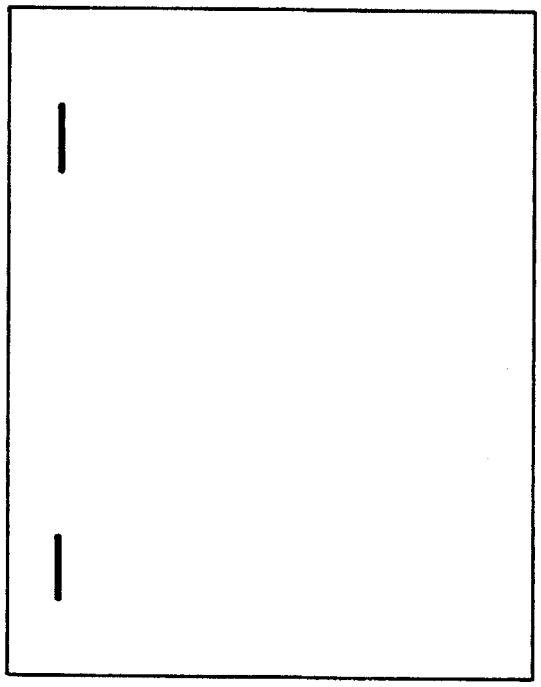
FIGS. 25A and 25B are views for explaining two-point stapling and one-point stapling, respectively.
Figure 25B:
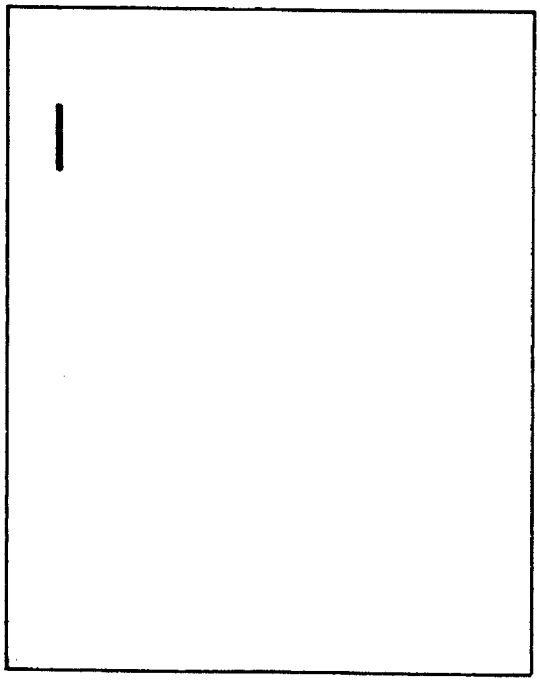

On the other hand, if NO in step (1), the CPU 1001 outputs a needle out signal to the main body 100 (5) and completes the processing. FIG. 25B illustrates the result of the staple processing at one point.

Figure 20:
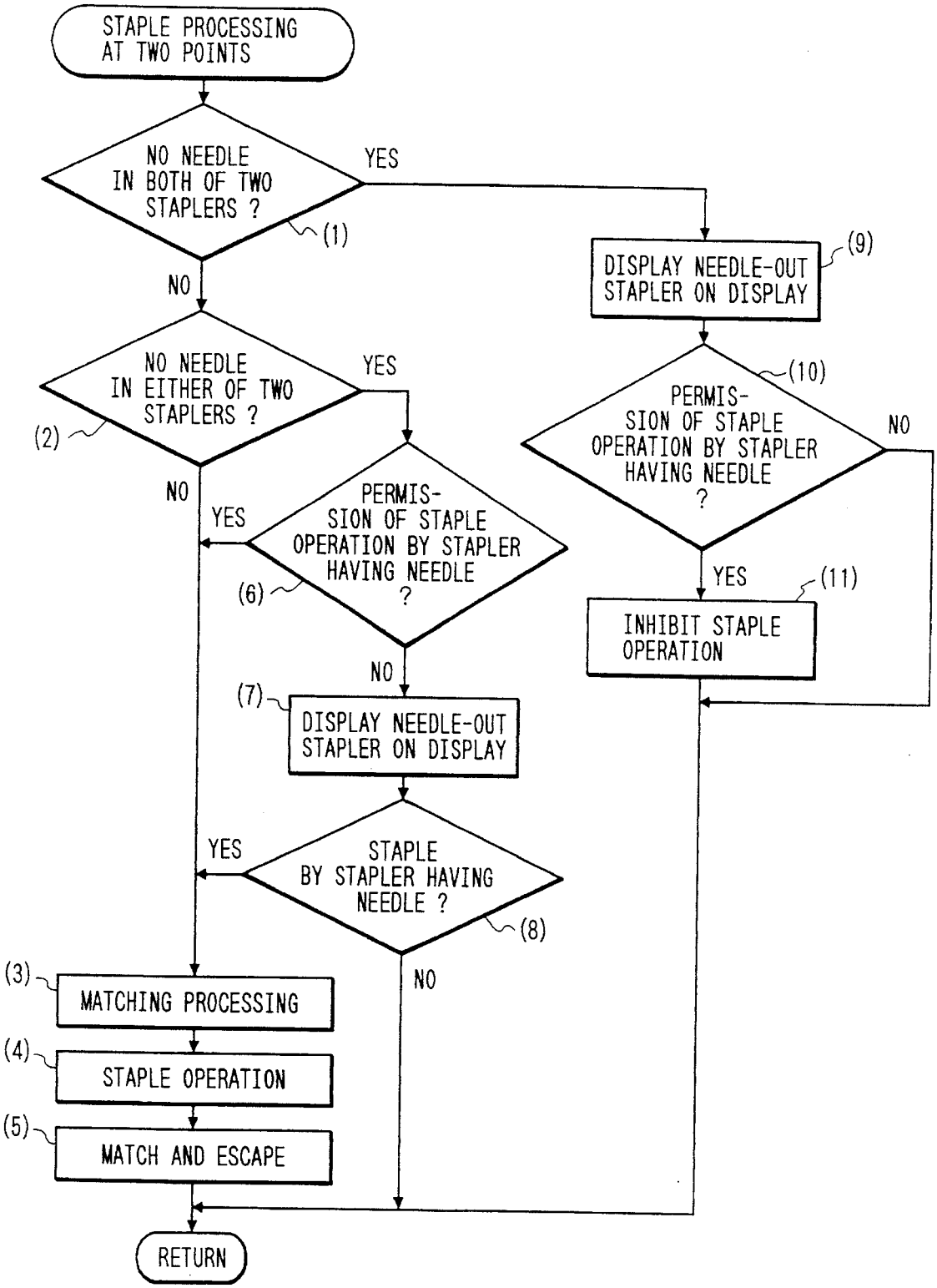
FIG. 20 is a flow chart showing a practical example of a detailed procedure of the routine of staple processing at two points shown in FIG. 18.

FIG. 20 is a flow chart showing a practical example of a detailed procedure of the routine of the staple processing at two points illustrated in FIG. 18. In FIG. 20, numerals (1) to (11) represent the step numbers. Note that the staplers 412*a* and 412*b* are used in the two-point binding.

In steps (1) and (2), the CPU 1001 checks whether needles are available in both of the two staplers and whether any needle is available in either of the two staplers, respectively. In the two-point binding, both the staplers 412*a* and 412*b* are used. In this determination of the presence/absence of needles, therefore, if either of the staplers has no needles, the CPU 1001 determines no needle is available for stapling.

If the two staplers have needles, the flow advances to step (3), and a bundle is pushed by the matching rod so as not to be mismatched. The flow then advances to step (4), and the CPU 1001 executes a staple operation. In this case the staplers 412*a* and 412*b* simultaneously perform the staple operation. However, the staple motors 432*a* and 432*b* can also be activated at slightly different timings so that the peak currents do not overlap. After the staple operation, the flow advances to step (5). In step (5) the CPU 1001 causes the matching rod 439*a* to escape and completes the staple processing at two points.

If the CPU 1001 determines no needle is available in step (2), the CPU 1001 checks whether a staple operation by a stapler having needles is permitted (6). If NO in step (6), the CPU 1001 displays the needle-out stapler on the message display (7) and asks a user whether a staple operation is to be performed by using the stapler having needles (8).

On the other hand, if the CPU 1001 determines a no-needle state in both the staplers in step (1), the CPU 1001 displays the needle-out staplers on the display (9). If a staple operation by a stapler having needles is permitted (10), the CPU 1001 inhibits the staple operation (11) and completes the processing. FIG. 25A shows the result of the staple processing at two points in which sheets are bound like a book.

Figure 21:
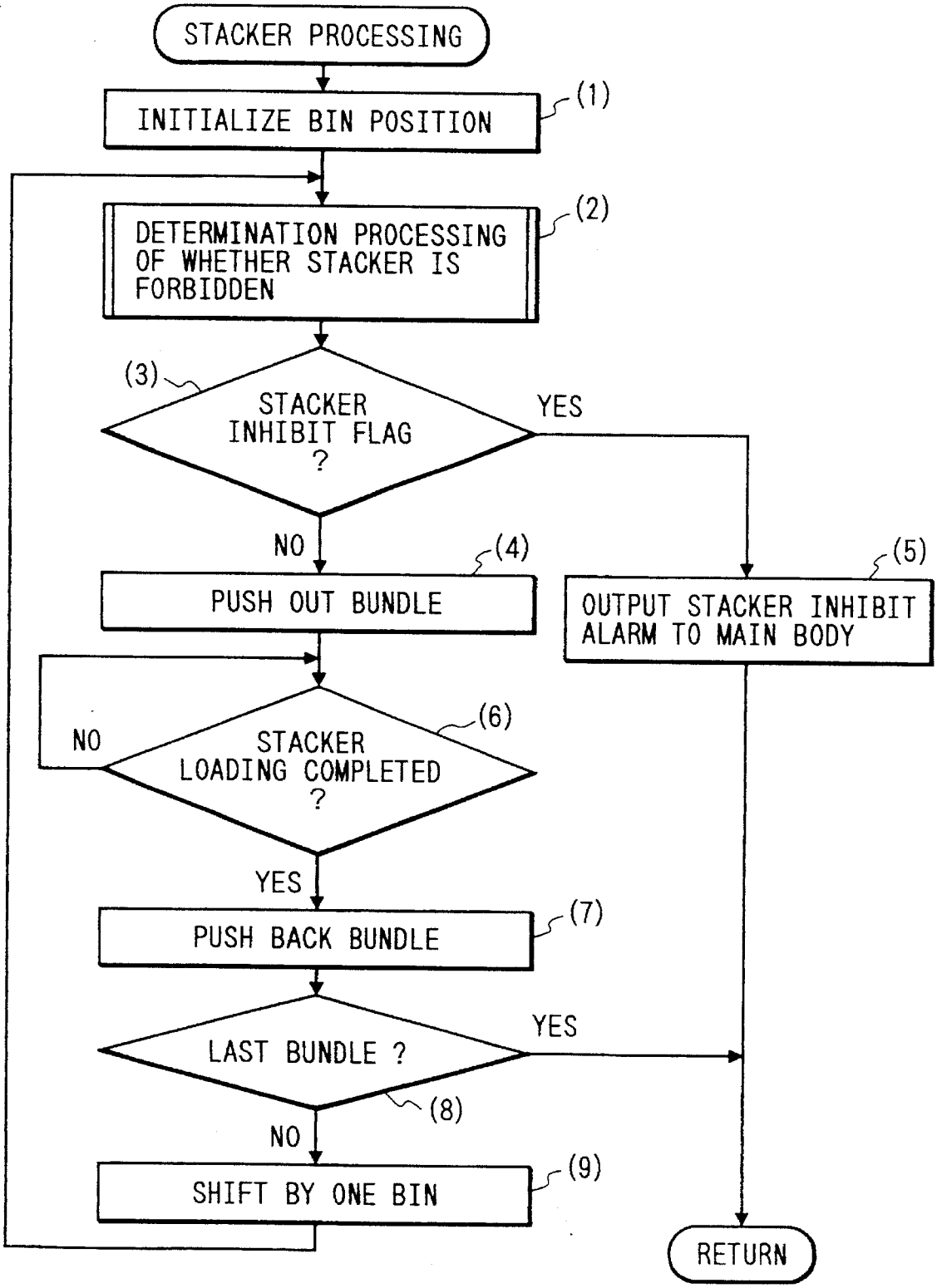
FIG. 21 is a flow chart showing a practical example of a detailed procedure of a stacker processing routine in FIG. 13.

FIG. 21 is a flow chart showing a practical example of a detailed procedure of the stacker processing routine in FIG. 13. In FIG. 21, numerals (1) to (9) indicate the step numbers.

First, the CPU 1001 initializes the bin position to perform a series of stacker processing operations (1). Note that the bin position to be initialized is one which is the uppermost or lowermost of usable bins and closest to the bin position currently being used. Upon completing the movement, the CPU 1001 sets a downward shift as the shift direction if the initialized bin position is the uppermost one, and sets an upward shift if the bin position is the lowermost one.

Subsequently, the flow advances to determination processing or,whether the stacker is forbidden (2), and the CPU 1001 checks whether a stacker inhibit flag of the stacker 500 is set (3). If the stacker inhibit flag of the stacker 500 is not set in step (3), the CPU 1001 uses the arm 450*b* to push out a bundle (4). The stacker 500 performs a stack operation. After the stack operation, the CPU 1001 checks whether information indicating completion of the stacker loading is transmitted through the serial communication mentioned before (6). If the stacker 500 completes the loading, the CPU 1001 returns the bundle pushing arm 450*b* (7) and checks whether the stacked bundle is the last bundle (8). If NO in step (8), the CPU 1001 executes a shift by one bin (9), and the flow returns to step (2).

On the other hand, if YES in step (3), the CPU 1001 outputs a stacker inhibit alarm to the main body 100 (5), completing the processing.

Figure 22:
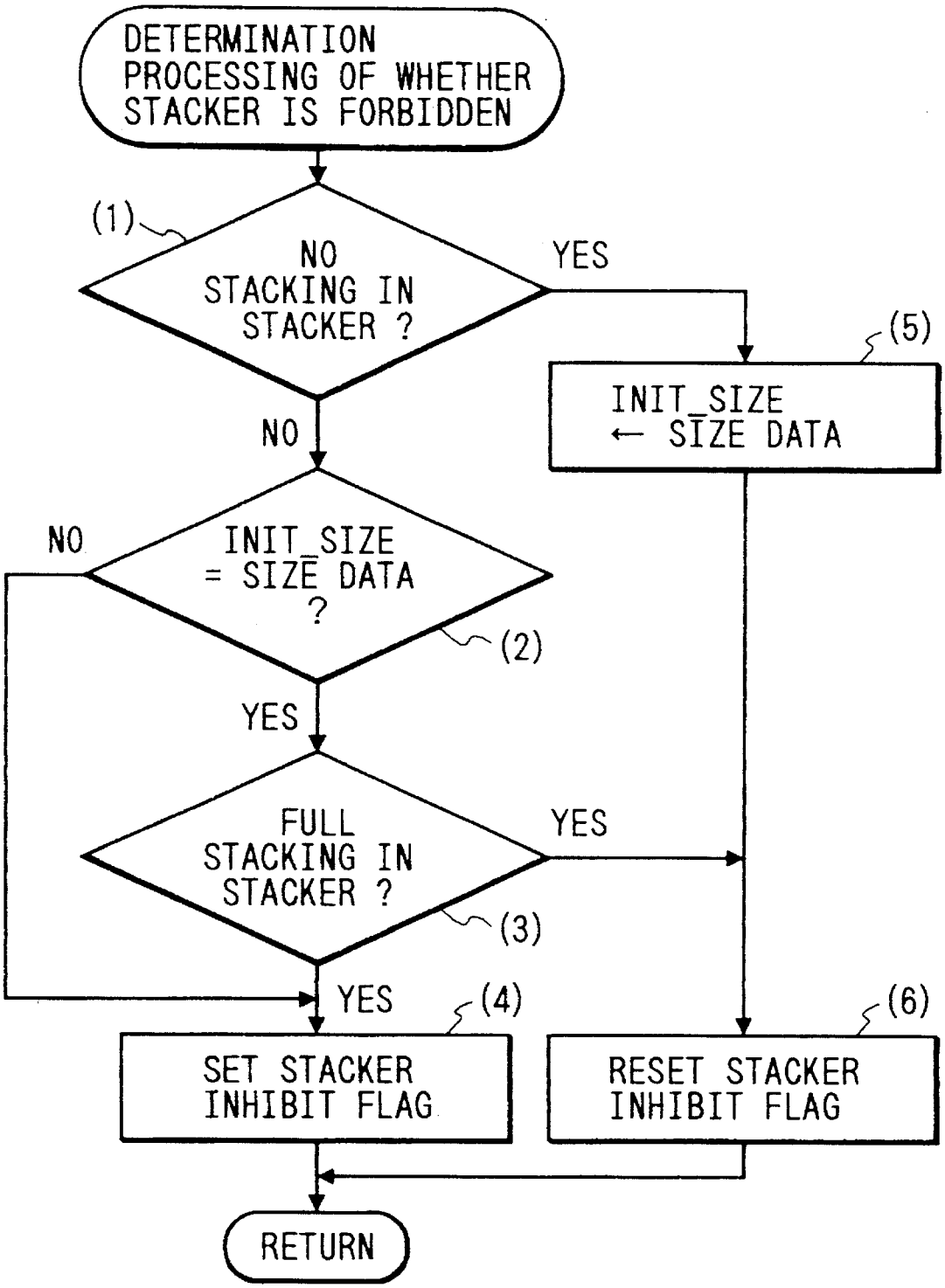
FIG. 22 is a flow chart showing a practical example of a detailed procedure of the routine of determination processing of whether use of a stacker is forbidden shown in FIG. 21.

FIG. 22 is a flow chart showing a practical example of a detailed procedure of the routine (FIG. 21) of the determination processing of whether use of the stacker is forbidden. In FIG. 22, numerals (1) to (6) indicate the step numbers.

In step (1), the CPU 1001 checks whether the stacker is in a no-stacking state. If YES in step (1), the CPU 1001 stores size data in initial stack size INIT_SIZE (5), resets the stacker inhibit flag (6), and completes the processing.

If NO in step (1), on the other hand, the CPU 1001 compares the initial stack size with the size data if the stacking state is already set (2). If the two data are different, the CPU 1001 sets the stacker inhibit flag (4). If the two data are in agreement, the CPU 1001 checks whether the stacker is in a full-stacking state (3). If YES in step (3), the CPU 1001 sets the stacker inhibit flag (6). If NO in step (3), the CPU 1001 resets the stacker inhibit flag (4) and completes the processing.

Figure 23:
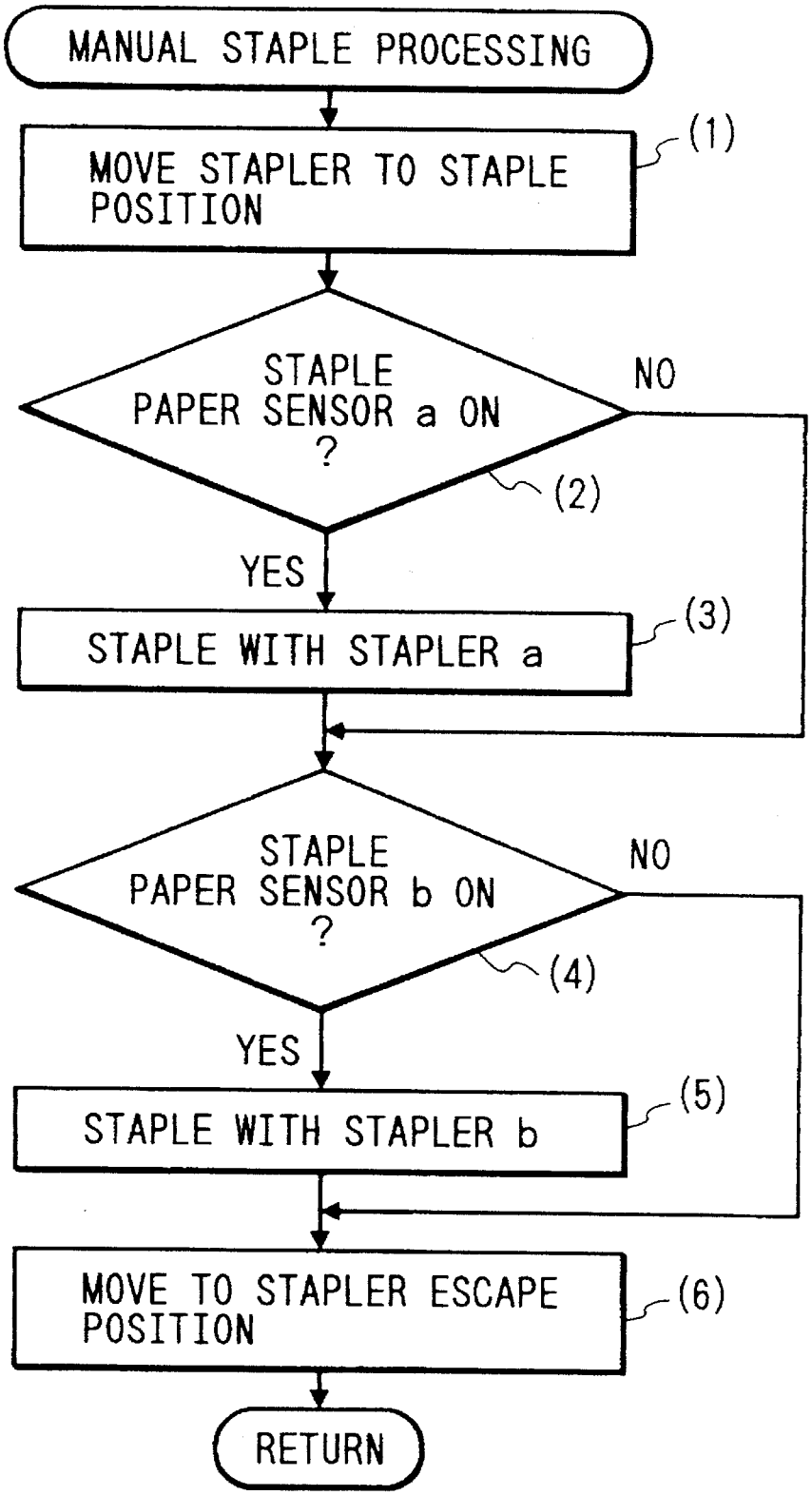
FIG. 23 is a flow chart showing a practical example of a manual staple processing routine shown in FIG. 13.

FIG. 23 is a flow chart showing a practical example of the manual staple processing routine in FIG. 13. In FIG. 23, numerals (1) to (6) indicate the step numbers.

The CPU 1001 first moves the staplers to the staple position (1). Upon completing the movement, the CPU 1001 checks whether paper is present at the position of a staple paper sensor a near the stapler 412*a* (2). If paper is present (YES) in step (2), the CPU 1001 performs stapling with the stapler 412*a* (3). If NO in step (2), the flow advances to step (4), and the CPU 1001 checks whether paper is present at the position of a staple paper sensor b (4). If NO in step (4), the flow advances to step (6). If YES in step (4), the CPU 1001 performs stapling with the stapler 412*b* (5). Thereafter, the CPU 1001 moves the staplers 412*a* and 412*b* to the escape position (6) to complete the processing. This processing allows a user to arbitrarily staple a paper bundle inserted into a bin.

Figure 24:
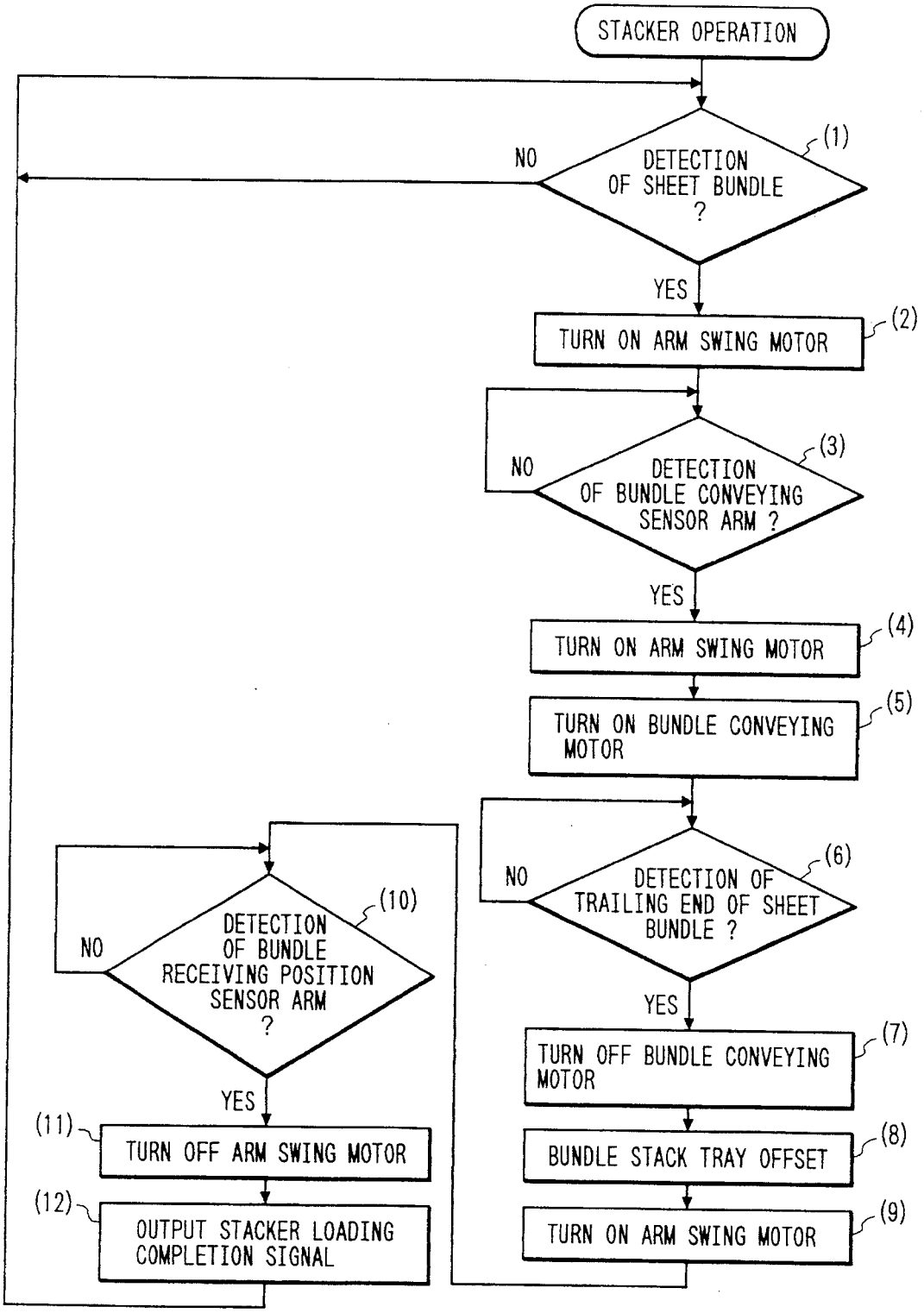
FIG. 24 is a flow chart showing details of the procedure of the control operation of the stacker shown in FIG. 1.

FIG. 24 is a flow chart showing details of the procedure of the control operation performed in the stacker 500 shown in FIG. 1. In FIG. 24, numerals (1) to (12) indicate the step numbers.

To begin with, the CPU 1101 checks whether the sheet bundle detecting sensor 510 detects a sheet bundle (1). =If YES in step (1), the CPU 1101 turns on the arm swing motor 507 (2). When the bundle conveying sensor detects the arm 503, the CPU 1101 stops the arm swing motor 507 (4). The CPU 1101 then turns on the bundle conveying motor (5) to convey the sheet bundle until the sheet bundle detecting sensor 510 detects the trailing end of the sheet bundle.

When the sheet bundle detecting sensor 510 detects the trailing end of the sheet bundle (6), the CPU 1101 turns off the bundle conveying motor (7), completing stacking of the sheet bundle onto the stack tray. The CPU 1101 then performs offsetting for the bundle stack tray to prepare for the subsequent sheet bundles (8). To execute the sheet bundle loading operation again, the CPU 1101 turns on the arm swing motor 507 (9) and waits until the bundle receiving position sensor detects the arm 503 (10). When the arm 503 is detected, the CPU 1101 turns off the arm swing motor (11). The CPU 1101 then outputs to the sorter 400 a stacker loading completion signal indicating the completion of the sheet bundle loading operation (12), and the flow returns to step (1).

Note that in the above embodiment, the control for halting the system is executed when over stacking is detected. However, it is also possible to check, when over stacking is detected, which of the stacker 500 or the sorter 400 is over-stacked, and to display the check result on the display 701 of the operation panel illustrated in FIG. 3.

As has been discussed above, on the basis of the image formation mode set by the image formation mode setting means the staple mode setting means automatically sets the first staple mode regardless of whether the staple mode selecting means selects the staple mode. Consequently, bookbinding can be performed for a bundle of sheets without causing any staple designation error.

In addition, the presence/absence of stapling materials in each of the stapling means is checked. In accordance with the check result, the first switching means enables or disables the first staple mode set by the staple mode setting means, thereby avoiding an event in which stapling is impossible.

Furthermore, the staple mode setting means automatically sets the first staple mode if the image formation mode setting means sets the both-side mode in which images are formed on both of the upper and lower surfaces of a sheet material. Therefore, after both-side image formation is performed for sheet materials, bookbinding can be automatically performed.

Also, the staple mode setting means automatically sets the first staple mode if the image formation mode setting means sets the cover mode, in which a cover is added to a bundle of sheets, as the image formation mode. Consequently, after a cover is added to sheet materials, bookbinding can be automatically performed.

If the first switching means disables the first staple mode set by the staple mode setting means by checking the presence/absence of stapling materials in each of the stapling means, the second switching means enables the first staple mode which is disabled by checking the state of the staple mode selection by the staple mode selecting means. Consequently, a user can switch the state of the staple processing from the disabled to the enabled state.

If the first switching means enables the first staple mode set by the staple mode setting means by checking the presence/absence of stapling materials in each of the stapling means, the second staple mode which is selected by a user is enabled, instead of the first staple mode that is automatically set, by the staple mode selecting means. This allows the user to perform staple processing other than bookbinding.

This makes it possible to prevent a stapling error caused by a user's staple mode selection error. Consequently, an optimum staple operation corresponding to each selected image formation mode can be automatically performed.

What is claimed is:

1. A stapling apparatus comprising:

stapling means for selectively performing stapling at one or plural points of a plurality of sheets ejected from an image forming apparatus; and control means for controlling said stapling means to perform stapling at a plurality of points of sheets ejected when said image forming apparatus is in a mode for forming images on both sides of sheet.

2. An apparatus according to claim 1, wherein said stapling means binds a plurality of sheets like a book by performing stapling at a plurality of points.

3. A stapling method comprising the steps of:

selectively performing stapling at one or a plurality of points of a plurality of sheets ejected from an image forming apparatus; and performing stapling at a plurality of points of sheets ejected when said image forming apparatus is in a mode for forming images on both sides of a sheet.

4. A method according to claim 3, wherein the stapling step binds a plurality of sheets like a book by performing stapling at a plurality of points.

5. An image forming system comprising:

image forming means for performing image formation on a sheet;

stapling means for selectively performing stapling at one or a plurality of points of a plurality of sheets ejected from said image forming means; and control means for controlling said stapling means to perform stapling at a plurality of points of sheets on which said image forming means has performed image formation in a mode for forming images on both sides of a sheet.

6. A system according to claim 5, wherein said stapling means binds a plurality of sheets like a book by performing stapling at a plurality of points.

7. An image forming system comprising:

a plurality of sheet feed means;

image forming means for forming an image on a sheet fed from any one of said plurality of sheet feed means;

stapling means for performing stapling at one or plural points on the sheet on which the image is formed; and selecting means for selecting one of a first mode in which the stapling at plural points is performed by said stapling means, and a second mode in which the stapling at one point is performed;

wherein said selecting means selects said first mode when a sheet fed from a designated one of said plurality sheet feed means is included in the sheets to be stapled.

8. An image forming system according to claim 7, wherein said designated one of said plurality of sheet feed means refeeds to said image forming means the sheet on which the image is formed by said image forming means.

9. An image forming system according to claim 7, wherein said designated one of said plurality of sheet feed means feeds the sheet to be a cover.

10. An image forming system according to claim 7, wherein said image forming means includes exposure means for exposing an original, and said image forming means forms an image of the original exposed by said exposure means on the sheet.

* * * * *

UNITED STATES PATENT AND TRADEMARK OFFICE

CERTIFICATE OF CORRECTION

PATENT NO. : 5,568,247

DATED : October 22, 1996

INVENTOR(S) : MITSUSHIGE MURATA, ET AL.

It is certified that error appears in the above-indentified patent and that said Letters Patent is hereby corrected as shown below:

COLUMN 1:

Line 16, "Sheets" should read --sheets--.

COLUMN 3:

Line 59, "transfer" should read --transfer,--.

COLUMN 4:

Line 9, "8 witching" should read --switching--.
Line 19, "both-Side" should read --both-side--.

COLUMN 7:

Line 29, "Which," should read --which--.

COLUMN 8:

Line 46, "Convey" should read --convey--.

COLUMN 9:

Line 12, "(μPD8251)" should read --(μPD8255--.

UNITED STATES PATENT AND TRADEMARK OFFICE

CERTIFICATE OF CORRECTION

PATENT NO. : 5,568,247 Page 2 of 2

DATED : October 22, 1996

INVENTOR(S) : MITSUSHIGE MURATA, ET AL.

It is certified that error appears in the above-indentified patent and that said Letters Patent is hereby corrected as shown below:

COLUMN 11:

Line 6, "stable=processing" should read --staple processing--.

COLUMN 12:

Line 24, "Shift" should read --shift--.
Line 30, "Us" should read --is--.

COLUMN 13:

Line 54, "any" should read --a--.

COLUMN 14:

Line 31, "or,whether" should read --of whether--.

COLUMN 15:

Line 20, "=If" should read --If--.

Signed and Sealed this

First Day of April, 1997

Bruce Lehman

*Attest:*

BRUCE LEHMAN

*Attesting Officer*

*Commissioner of Patents and Trademarks*